US005197658A

United States Patent [19]

Sprunger

[11] Patent Number: 5,197,658

[45] Date of Patent: Mar. 30, 1993

[54] EXPANDABLE AND REVERSIBLE CONTAINERS

[76] Inventor: Powell L. Sprunger, 20 Woodview La., Algonquin, Ill. 60102

[21] Appl. No.: 605,505

[22] Filed: Oct. 30, 1990

Related U.S. Application Data

[63] Continuation-in-part of Ser. No. 530,570, May 30, 1990, abandoned.

[51] Int. Cl.[5] ..... B65D 5/56

[52] U.S. Cl. ..... 229/93; 220/461; 220/504; 220/530; 383/104

[58] Field of Search ..... 229/93; 383/33, 119, 383/104; 141/316, 390; 220/504, 530, 461, 462, 463

[56] References Cited

U.S. PATENT DOCUMENTS

| | | | |
|---|---|---|---|
| 2,182,879 | 12/1939 | Rinehart | 383/33 |
| 2,611,499 | 9/1952 | Mayer | 220/504 |
| 2,628,673 | 2/1953 | Ericson | 220/530 |
| 2,678,764 | 5/1954 | Carlson | 141/390 |
| 3,542,566 | 11/1970 | Wakefield | 383/119 |
| 3,777,498 | 12/1973 | Andrews et al. | 383/33 |
| 4,280,676 | 7/1981 | Betts | 141/316 |
| 4,284,205 | 8/1981 | Hirata | 220/461 |
| 4,344,781 | 8/1982 | Higgins et al. | 383/119 |
| 4,457,483 | 7/1984 | Gagné141 | 316/ |
| 4,485,855 | 12/1984 | Dillingham | 141/316 |

*Primary Examiner*—Gary E. Elkins

*Attorney, Agent, or Firm*—Powell L. Sprunger

[57] ABSTRACT

A container comprising, a sidewall defining a cavity, and a liner secured to the sidewall and being movable in the cavity between different positions in the container.

15 Claims, 36 Drawing Sheets

EXPANDABLE AND REVERSIBLE CONTAINERS

CROSS-REFERENCE TO RELATED APPLICATION

This application is a continuation-in-part of application Ser. No. 530,570, filed May 30, 1990 now abandoned.

BACKGROUND OF THE INVENTION

The present invention relates to containers.

In the past, various containers or packages have been utilized for such purposes as storing or collecting articles. Sometimes separate packages or bags have been utilized with such containers for the articles However, the containers have not been sufficiently receptive for numerous uses, and must be specially tailored for each condition. Such containers may be open or closed.

SUMMARY OF THE INVENTION

A principle feature of the present invention is the provision of an improved container of simplified construction.

The container or package of the present invention comprises, a sidewall, and a liner secured to a central portion of the sidewall.

A feature of the invention is that the liner may be moved between positions adjacent opposed ends of the sidewall.

Another feature of the invention is that the sidewall may be placed upon a support surface in an upright or inverted configuration in order to store articles in the container.

Thus, a feature of the invention is that the container is reversible in orientation.

A feature of the invention is that the container may have a cap closing at least on end of the sidewall.

Another feature of the invention is that the container may have caps closing both ends of the sidewall.

Yet another feature of the invention is that the caps may be releasably attached to the sidewall.

A further feature of the invention is that the caps may be secured in sealing engagement to the sidewall.

Thus, a feature of the invention is that the container may be open or closed.

In another embodiment, the container or package of the present invention comprises, a sidewall, and a liner secured adjacent one end of the sidewall.

A feature of the invention is that the liner may be moved between positions adjacent the other end of the sidewall and outside of the sidewall.

Thus, a feature of the invention is that the container is expandable in order to increase or decrease the effective size of the container.

Further features will become more fully apparent in the following description of the embodiments of this invention and from the appended claims.

DESCRIPTION OF THE PREFERRED EMBODIMENTS

Figure 1:
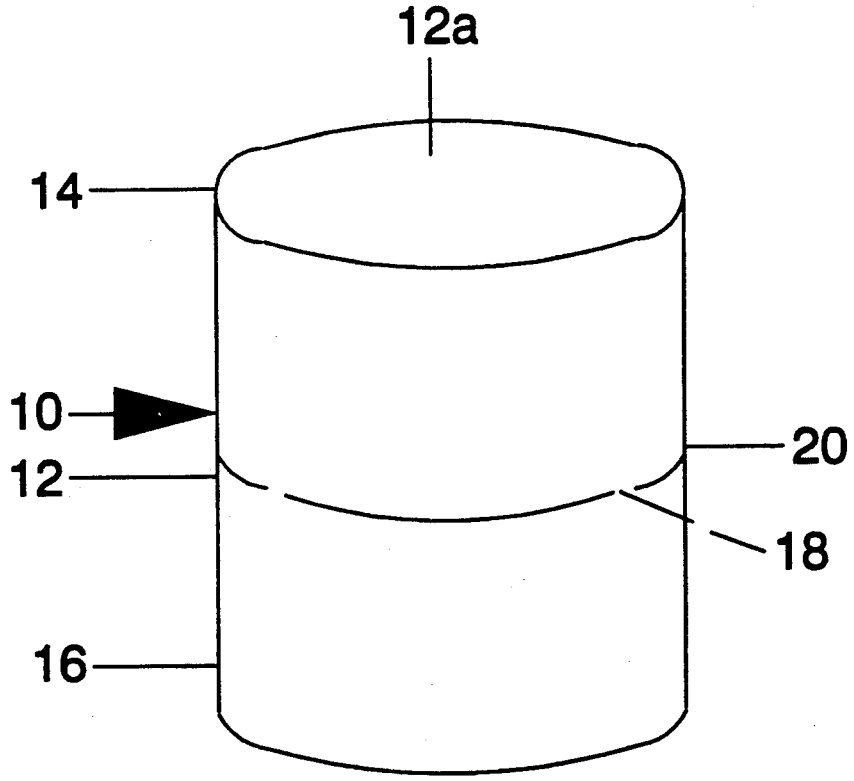
FIG. 1 is a perspective view of a container of the present invention.
Figure 2:
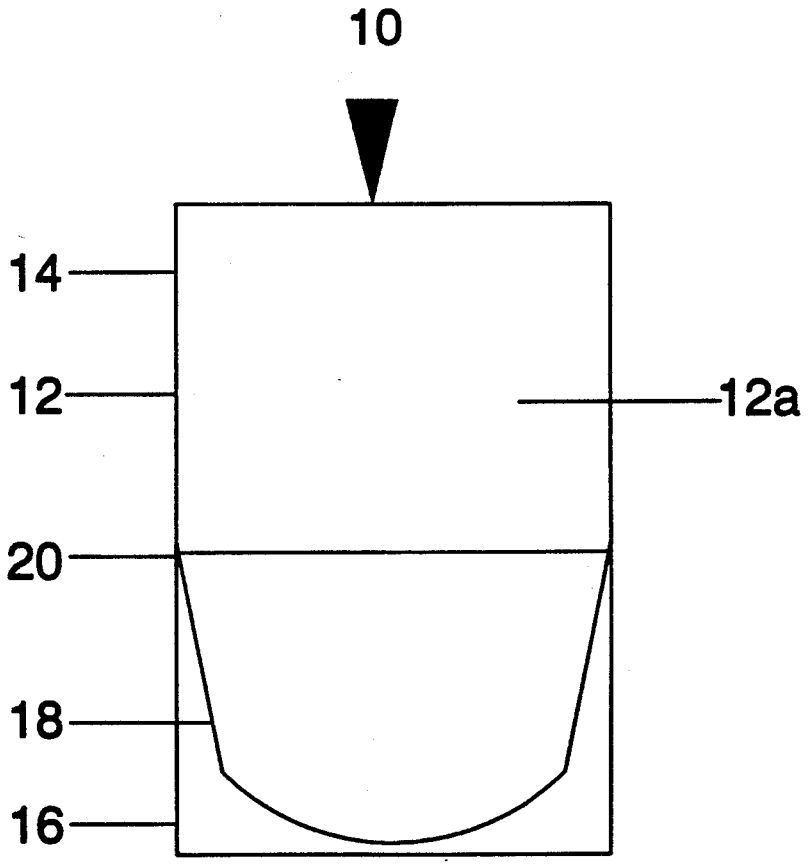
FIG. 2 is a sectional view of the container in an upright configuration.
Figure 3:
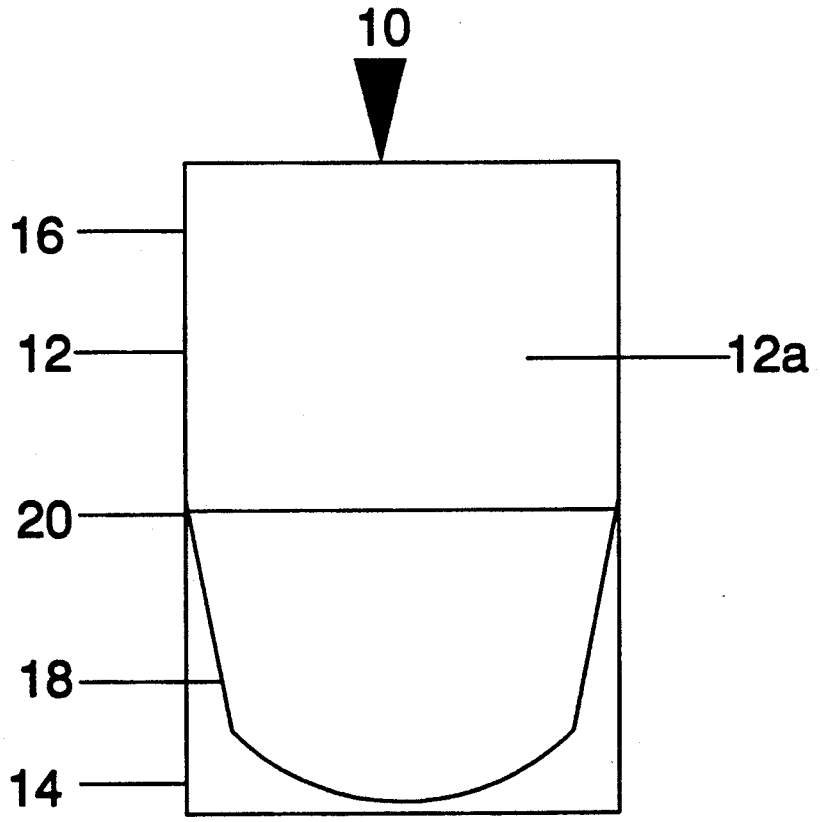
FIG. 3 is a sectional view of the container of FIG. 1 in an inverted configuration.

Referring now to FIGS. 1-3, there is shown a container generally designated 10 having a tube or cylinder 12 defining a cavity 12*a* and a pair of opposed ends 14 and 16. The container 10 has a flexible liner 18 secured to a central portion 20 of the tube 12, such that the liner 18 may be moved between a first position with the liner 18 located adjacent the end 16 of the tube in an upright position of the tube 12, as shown in FIG. 2, and a second position with the liner 18 located adjacent the other end 14 of the tube 12, as shown in FIG. 3. The liner 18 may be any suitable type of flexible material, such as a fluid impervious plastic material, paper, or aluminum foil.

Thus, the container 10 may be utilized to store articles in the cavity 12*a* of the tube 12 in either the upright configuration of the container, as shown in FIG. 2, or the inverted configuration of the container, as shown in FIG. 3. In either case, the liner 18 serves to receive and store the articles in the cavity 12*a*, and the tube 12 facilitates to pour the articles from the container. If desired, the container may be reversed in configuration once it has been used in the other configuration. Thus, the container is reversible in use.

Figure 4:
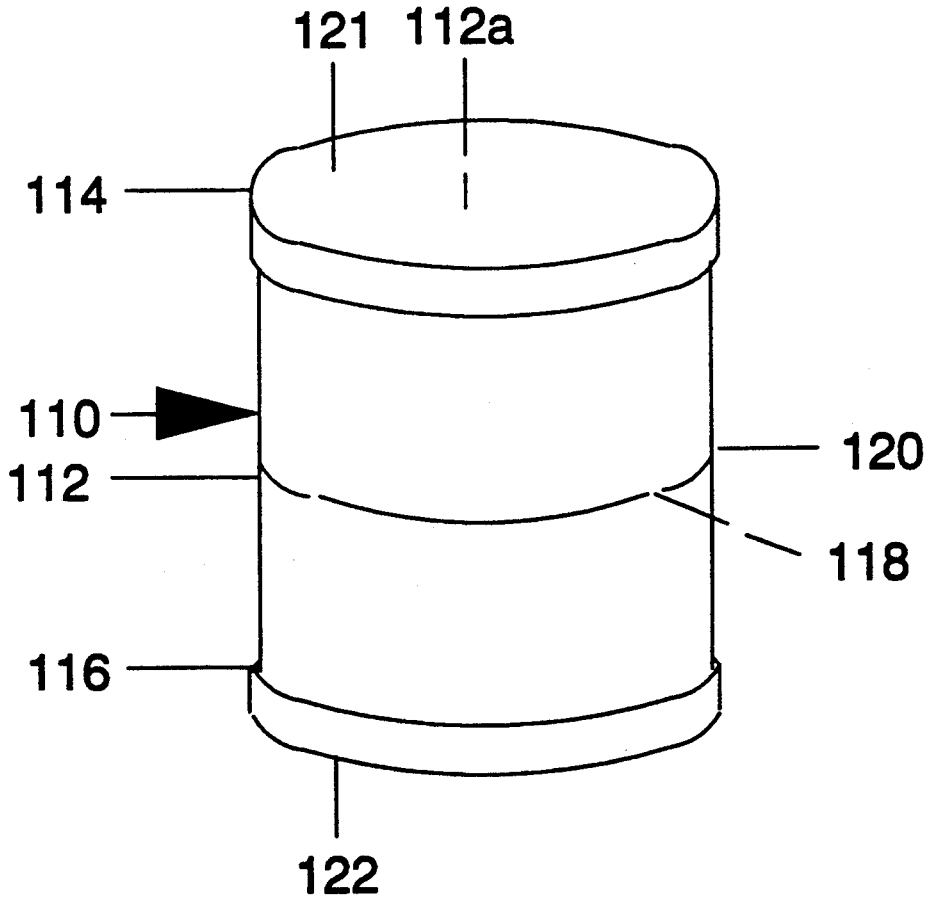
FIG. 4 is a perspective view of another embodiment of the container of the present invention.
Figure 5:
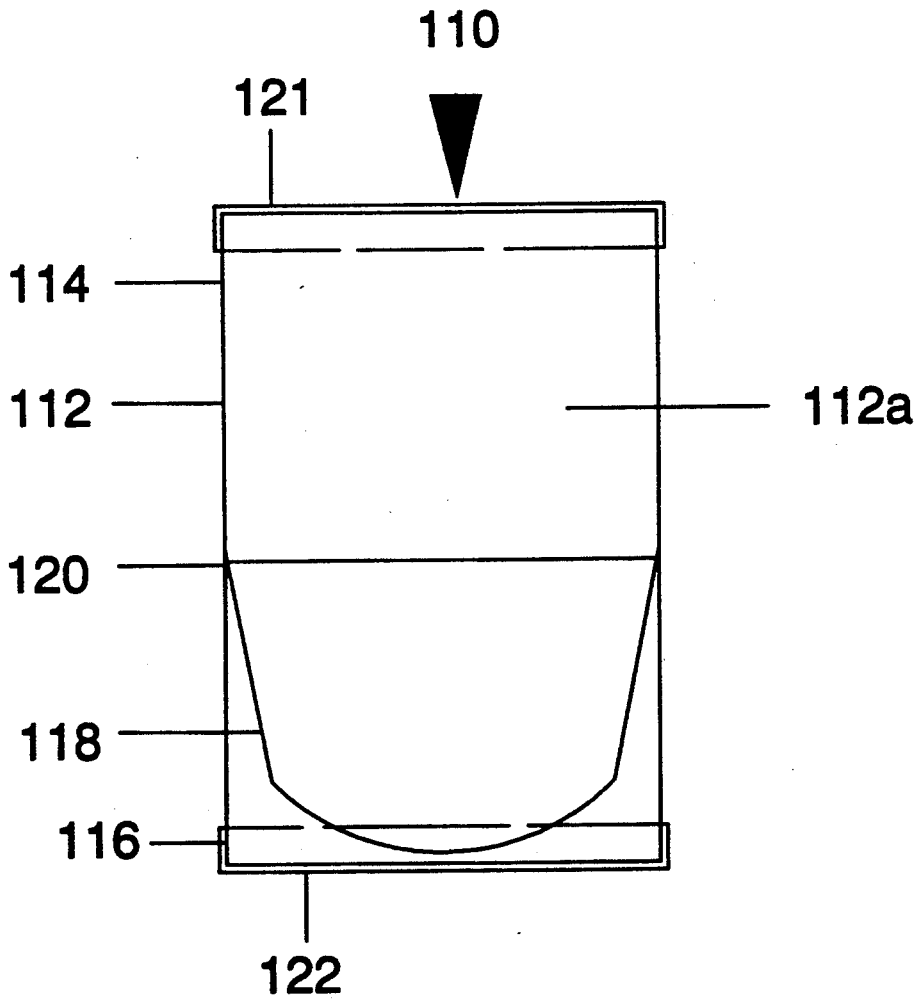
FIG. 5 is a sectional view of the container of FIG. 4 in an upright configuration.
Figure 6:
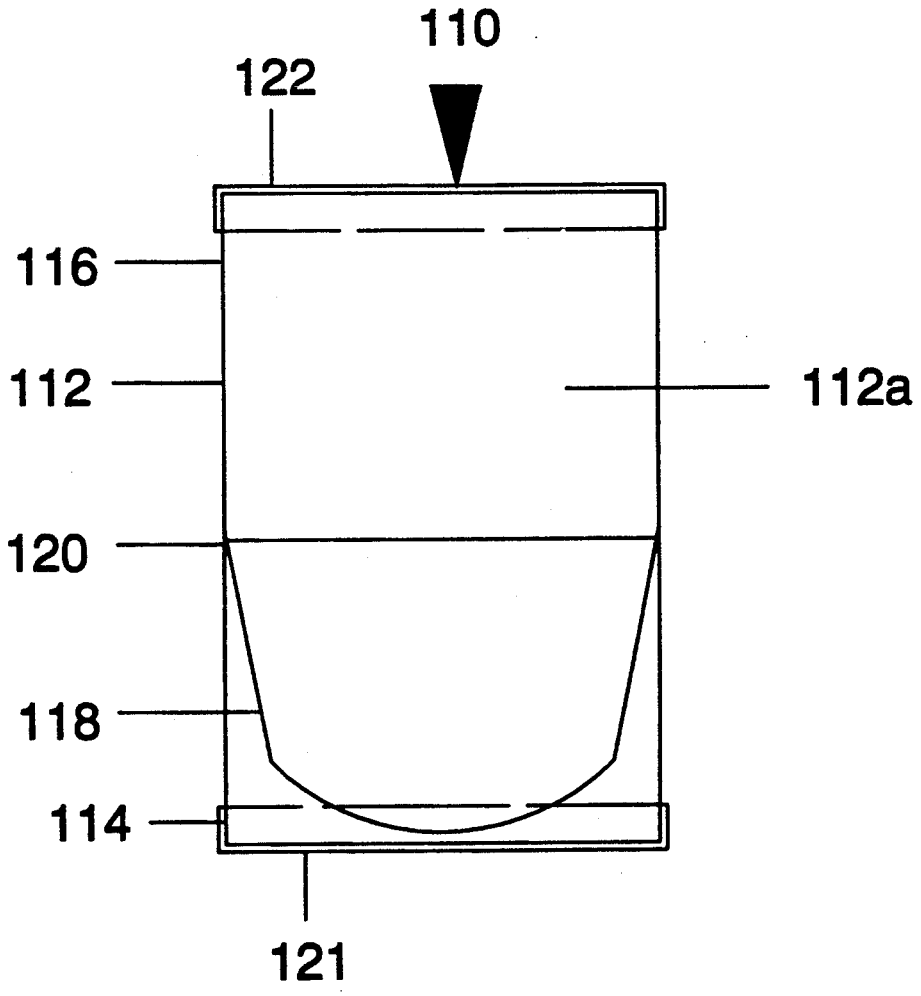
FIG. 6 is a sectional view of the container of FIG. 4 in an inverted configuration.

Another embodiment of the present invention is illustrated in FIGS. 4-6. In this embodiment, the container 110 has a tube or cylinder 112 defining a cavity 112*a* and a pair of opposed ends 114 and 116. The container 110 has a flexible liner 118 secured to a central portion 120 of the tube 112, such that the liner 118 may be moved between a first position with the liner 118 located adjacent the end 116 of the tube in an upright position of the tube 118, as shown in FIG. 5, and a second position with the liner 118 located adjacent the other end 114 of the tube 112, as shown in FIG. 6. The liner 118 may be any suitable type of flexible material, such as a fluid impervious plastic material, paper, or aluminum foil.

Thus, the container 110 may be utilized to store articles in the cavity 112*a* of the tube 112 in either the upright configuration of the container, as shown in FIG. 5, or the inverted configuration of the tube, as shown in FIG. 6. In either case, the liner 118 serves to receive and store the articles in the cavity 112*a*, and the tube 112 facilitates to pour the articles from the container. If desired, the container may be reversed in configuration once it has been used in the other configuration. Thus, the container is reversible in use.

The container 110 has a pair of caps or lids 121 and 122 closing the opposed ends 114 and 116 of the tube 112. The caps 121 and 122 may be releasably secured to the tube 112 or the caps 121 and 122 may be secured in sealing engagement to the tube 112. Thus, the container 110 is open or closed.

Figure 7:
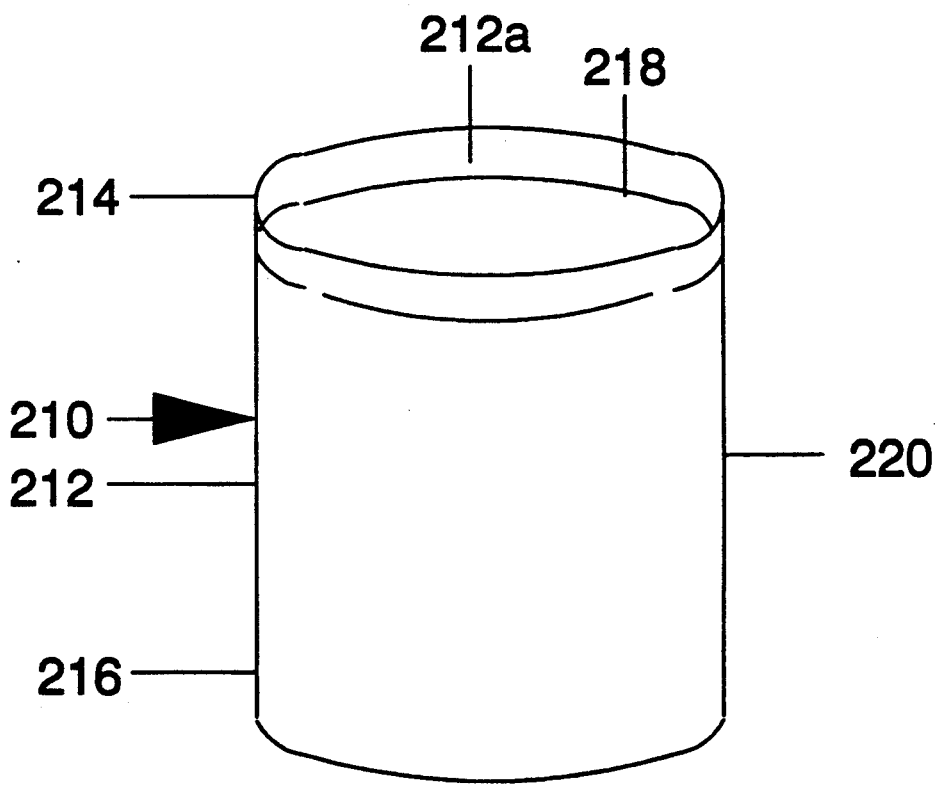
FIG. 7 is a perspective view of the container of the present invention.
Figure 8:
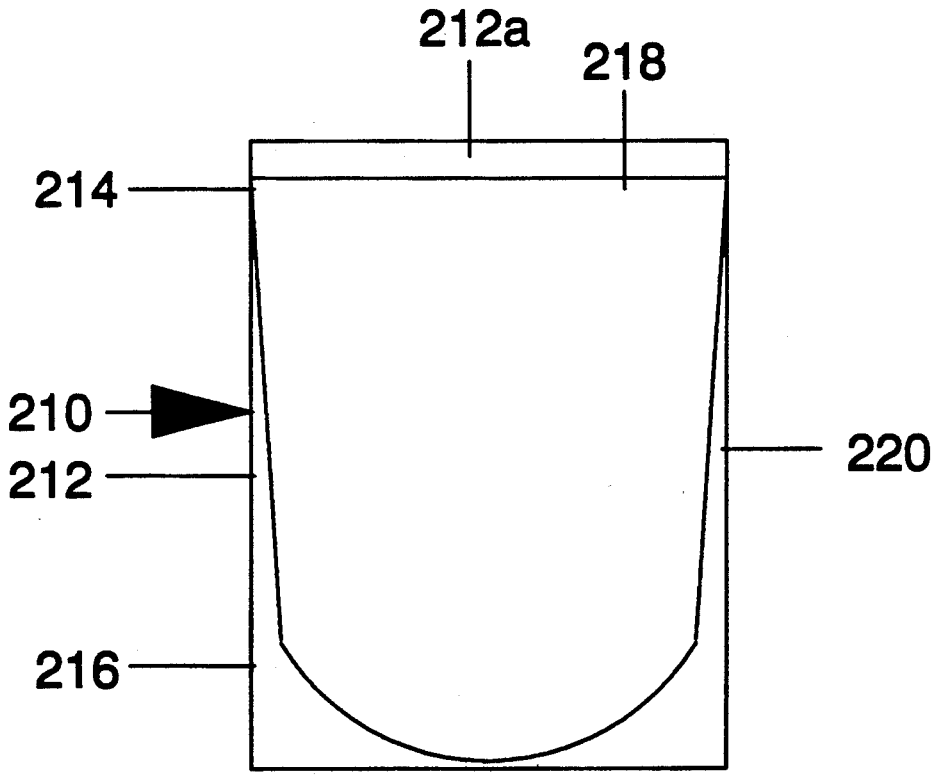
FIG. 8 is a sectional view of another embodiment of the container of FIG. 7 with a liner in a retracted configuration.
Figure 9:
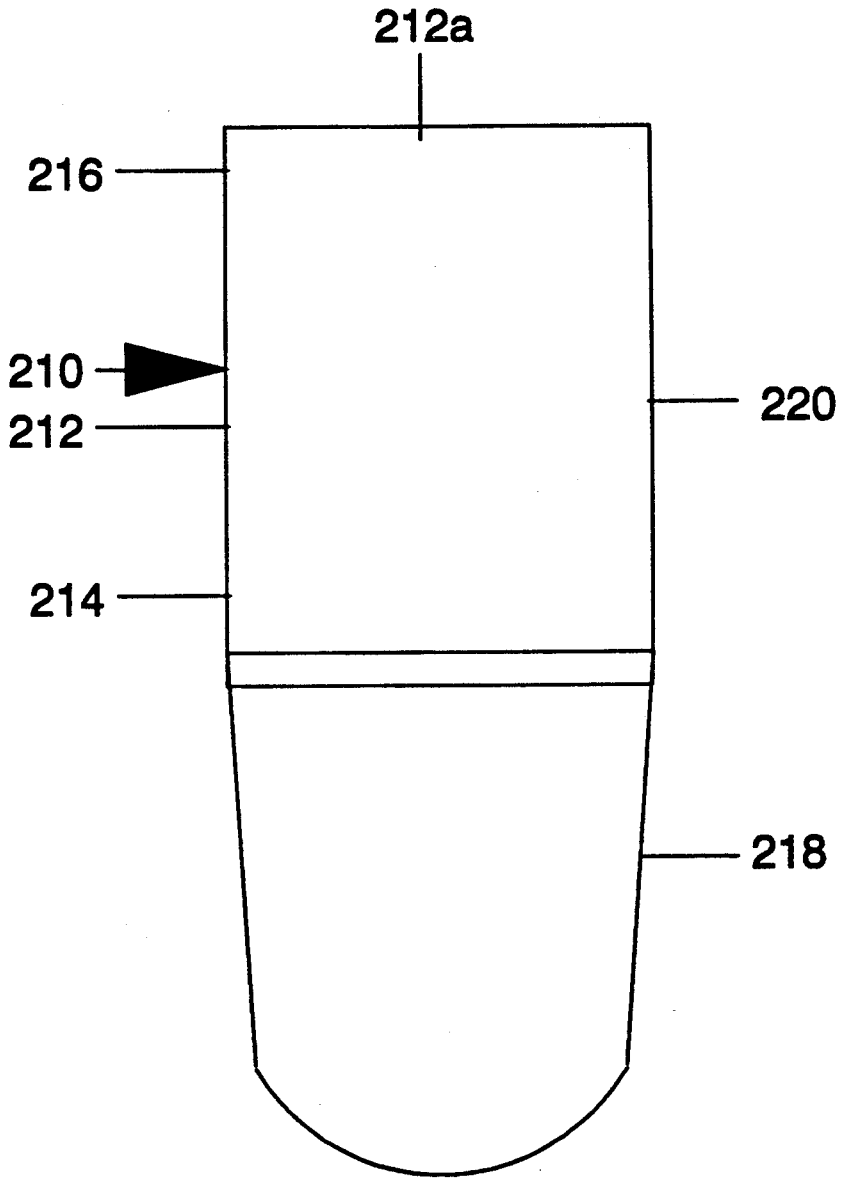
FIG. 9 is a sectional view of the container of FIG. 7 with the container in an inverted configuration and with the liner in an expanded configuration.

Another embodiment of the present invention is illustrated in FIGS. 7-9. In this embodiment, the container 210 has a tube 212 defining a cavity 212*a*, a pair of opposed ends 214 and 216, and a central portion 220. The container 210 has a flexible liner 218 secured adjacent one end 214 of the tube 212, such that the liner 18 may be moved between a first position with the liner 218 located adjacent the end 216 of the tube inside the tube 212 in an upright position of the tube 212, as shown in FIG. 8, and a second position with the liner 218 located outside of the tube 212 as shown in FIG. 9, in an inverted configuration of the tube 212. The liner 218 may be any suitable type of flexible material, such as a fluid impervious plastic material, paper, or aluminum foil.

Thus, the container 210 may be utilized to store articles in the cavity 212*a* of the tube 212 in either the retracted configuration of the container, as shown in FIG. 8, or the expanded configuration of the tube, as shown in FIG. 9. In either case, the liner 218 serves to receive and store the articles in the cavity 12*a*, and the tube facilitates to pour the articles from the container. Thus, the effective size of the container may be expanded or diminished to suit the use, as desired.

Figure 10:
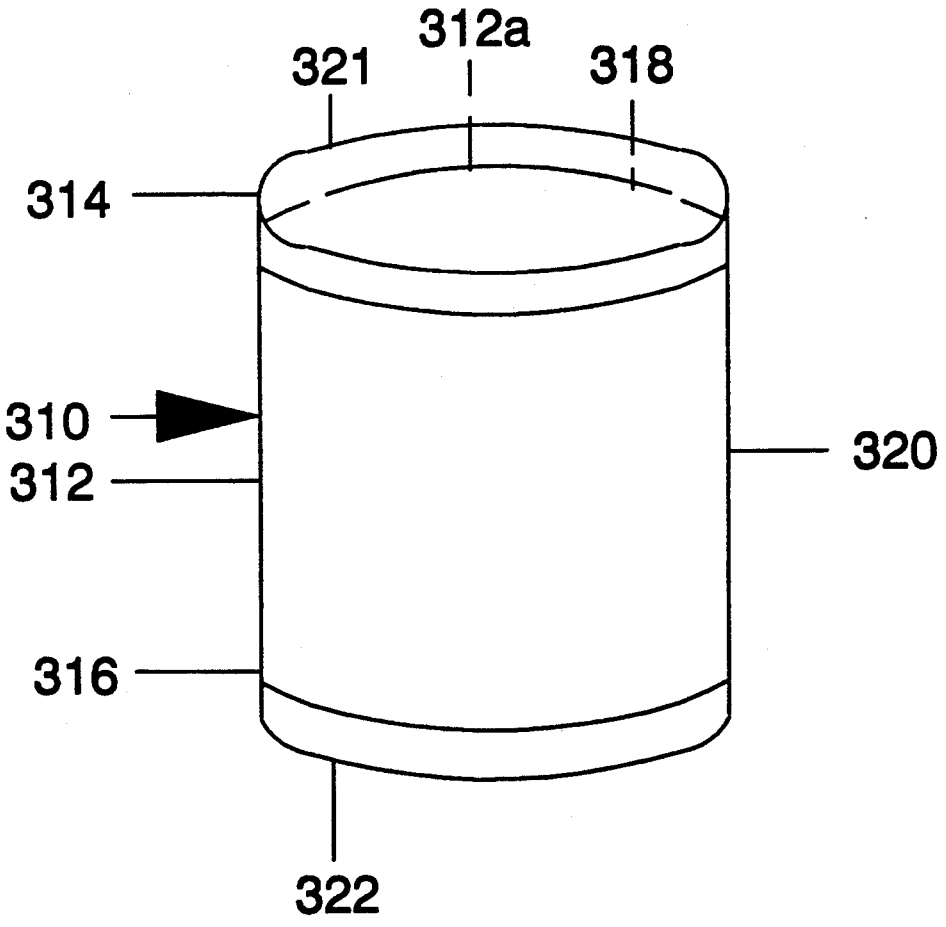
FIG. 10 is a perspective view of another embodiment of the container of the present invention.
Figure 11:
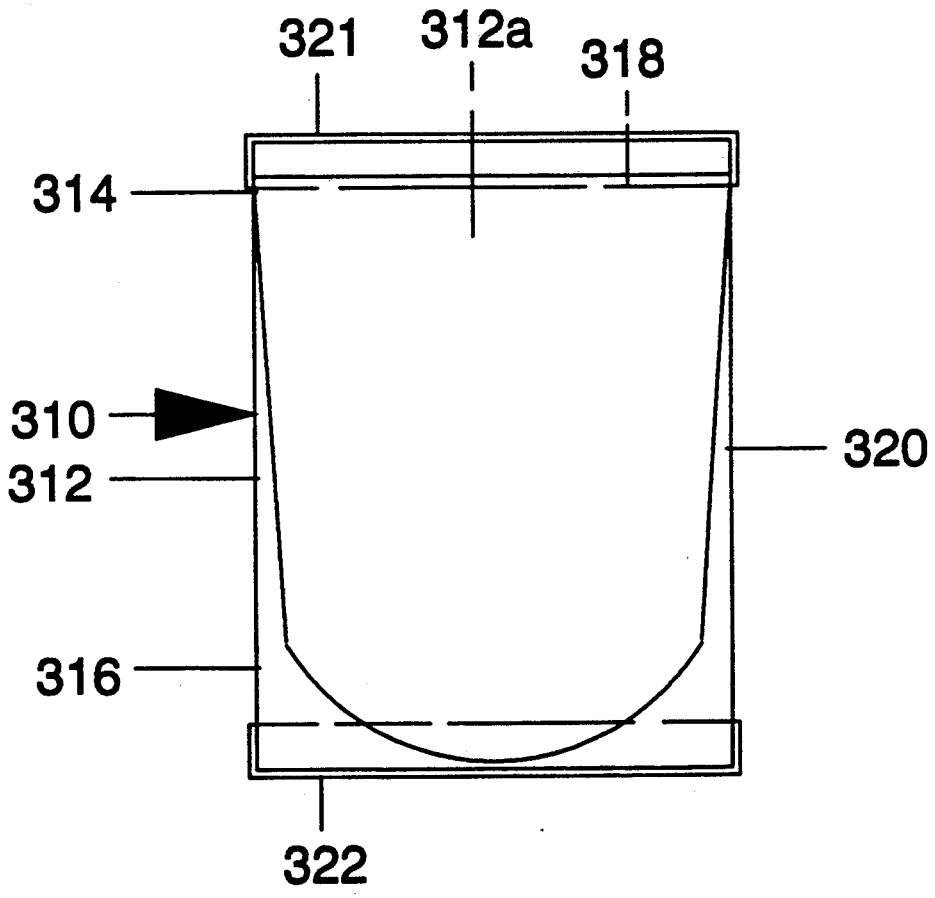
FIG. 11 is a sectional view of the container of FIG. 10 with a liner in a retracted configuration.
Figure 12:
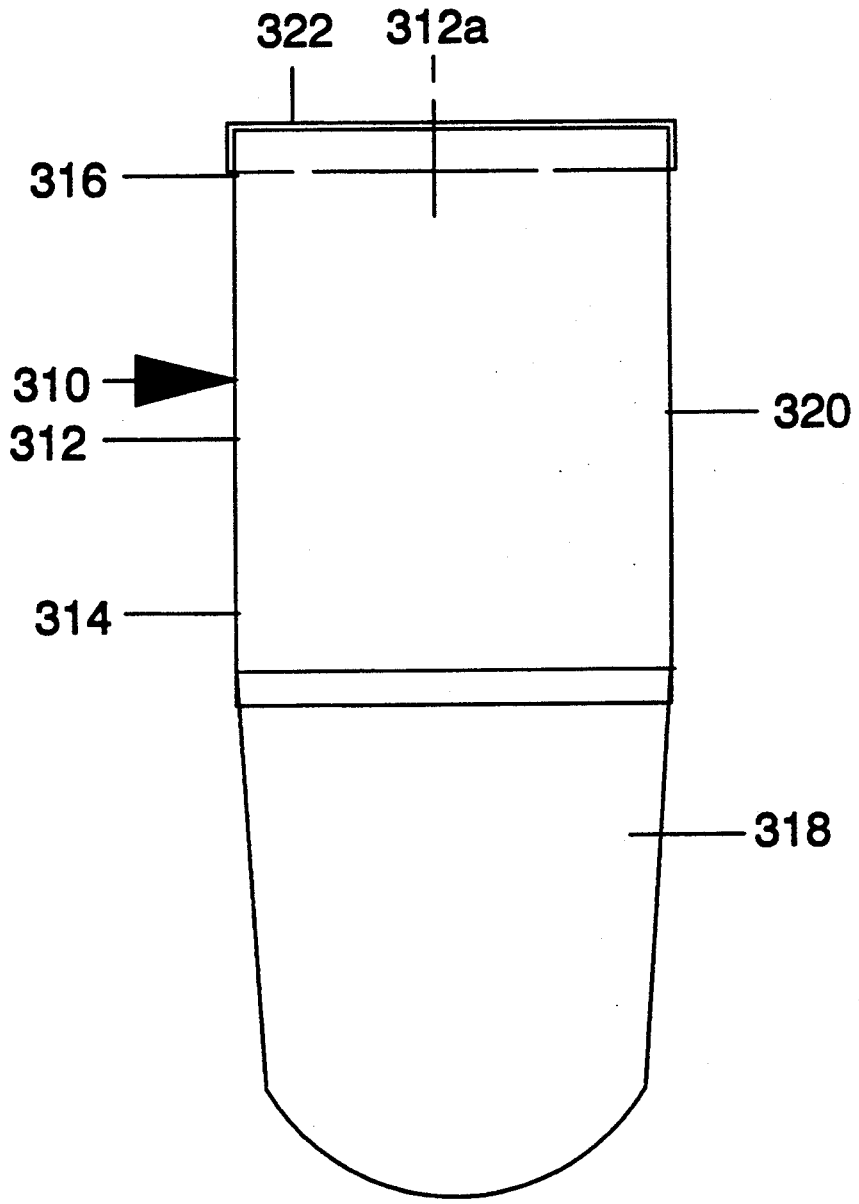
FIG. 12 is a sectional view of the container of FIG. 10 with the container in an inverted configuration and with the liner in an expanded configuration.

Another embodiment of the present invention is illustrated in FIGS. 10-12, In this embodiment, the container 310 has a tube or cylinder 312 defining a cavity 312*a*, a pair of opposed ends 314 and 316, and a central portion 320. The container 310 has a flexible liner 318 secured adjacent one end 314 of the tube 310, such that the liner 318 may be moved between a first position with the liner 318 located adjacent the end 316 of the tube inside the tube 312 in an upright position of the tube 310, as shown in FIG. 11, and a second position with the liner 318 located outside of the tube 310, as shown in FIG. 12, in an inverted configuration of the tube 312. The liner 318 may be any suitable type of flexible material, such as a fluid impervious plastic material, paper, or aluminum foil.

Thus, the container 310 may be utilized to store articles in the cavity 312*a* of the tube 312 in either the retracted configuration of the container, as shown in FIG. 11, or the expanded configuration of the tube, as shown in FIG. 12. In either case, the liner 318 serves to receive and store the articles in the cavity 312*a*, and the tube 312 facilitates to pour the articles from the container. Thus, the effective size of the container may be expanded or diminished to suit the use, as desired.

The container 310 has a pair of caps or lids 321 and 322 closing the opposed ends 314 and 316 of the tube 312. The caps 321 and 322 may be releasably secured to the tube 312 or the caps 321. and 322 may be secured in sealing engagement to the tube 312. Thus, the container 310 is open or closed.

Figure 13:
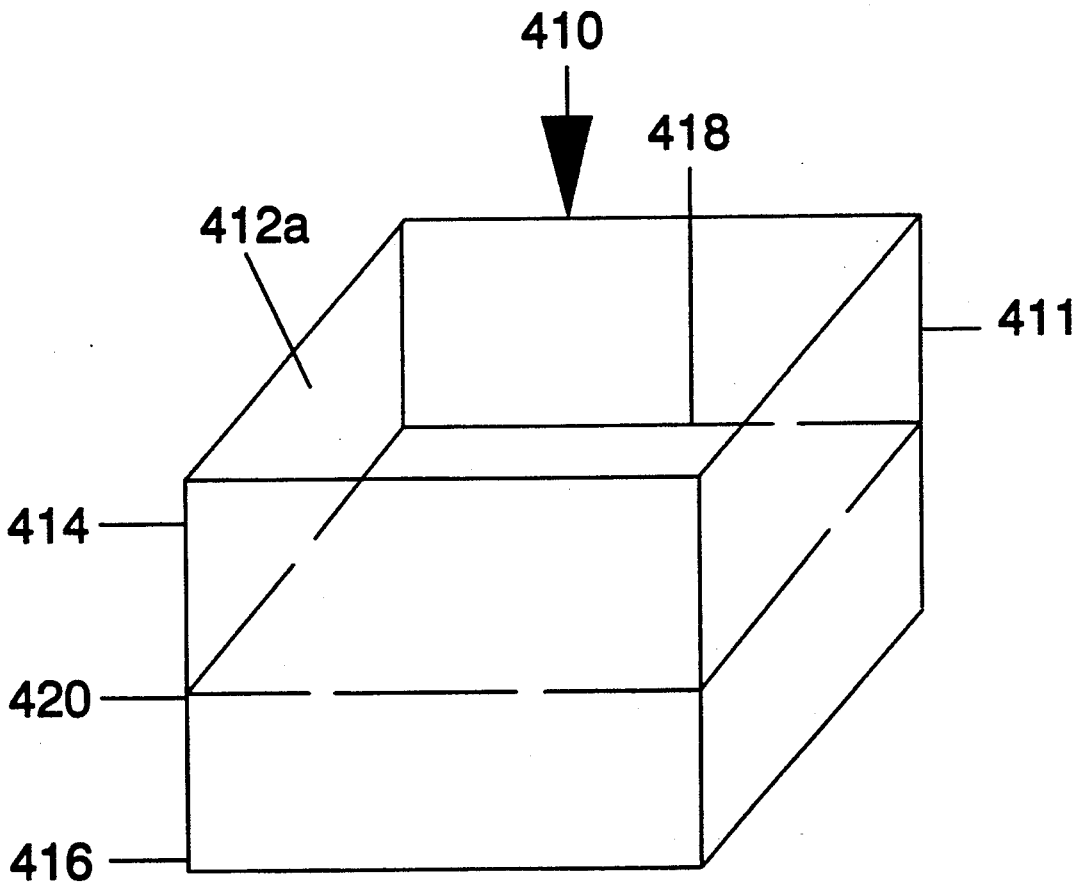
FIG. 13 is a perspective view of another embodiment of the container of the present invention.
Figure 14:
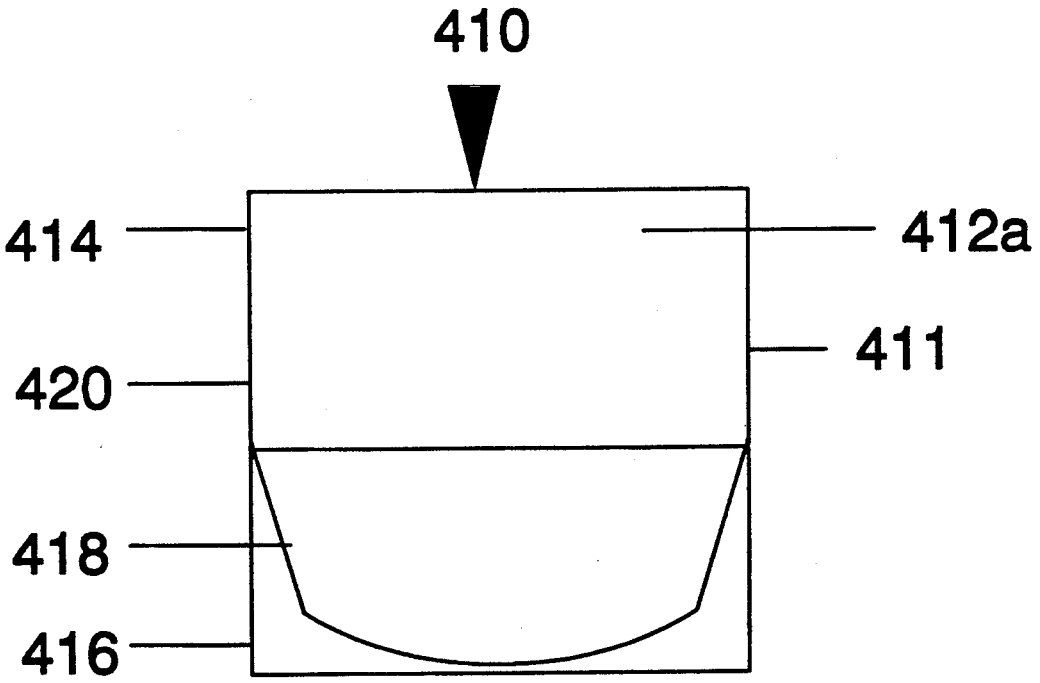
FIG. 14 is a sectional view of the container of FIG. 13 in an upright configuration.
Figure 15:
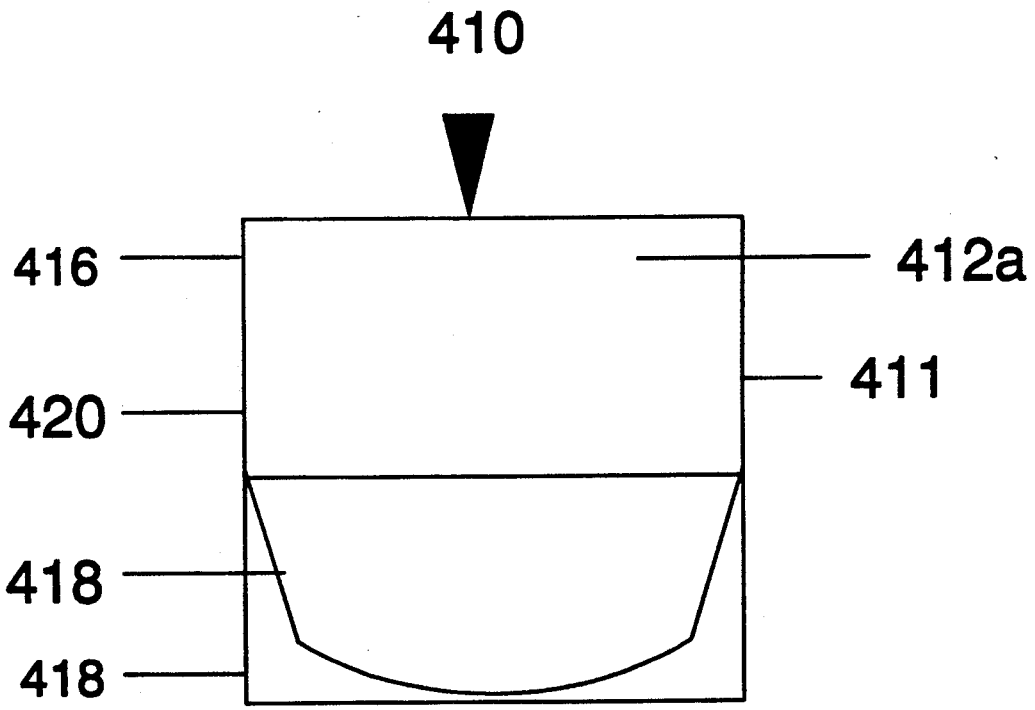
FIG. 15 is a sectional view of the container of FIG. 13 in an inverted configuration.

Another embodiment of the present invention is illustrated in FIGS. 13-15. In this embodiment, the container 410 has a sidewall 411 preferably having a rectangular shape defining a cavity 412*a* and a pair of opposed ends 414 and 416. The container 410 has a flexible liner 418 secured to a central portion 420 of the sidewall 411, such that the liner 418 may be moved between a first position with the liner 418 located adjacent the end 416 of the sidewall in an upright position of the container 410, as shown in FIG. 14, and a second position with the liner 418 located adjacent the other end 414 of the sidewall 411, as shown in FIG. 15. The liner 418 may be any suitable type of flexible material, such as a fluid impervious plastic material, paper, or aluminum foil.

Thus, the container 410 may be utilized to store articles in the cavity 412*a* of the sidewall 411 in either the upright configuration of the container, as shown in FIG. 14, or the inverted configuration of the container, as shown in FIG. 15. In either case, the liner 418 serves to receive and store the articles in the cavity 412*a*, and the sidewall 411 facilitates to pour the articles from the container. If desired, the container may be reversed in configuration once it has been used in the other configuration. Thus, the container is reversible in use.

Figure 16:
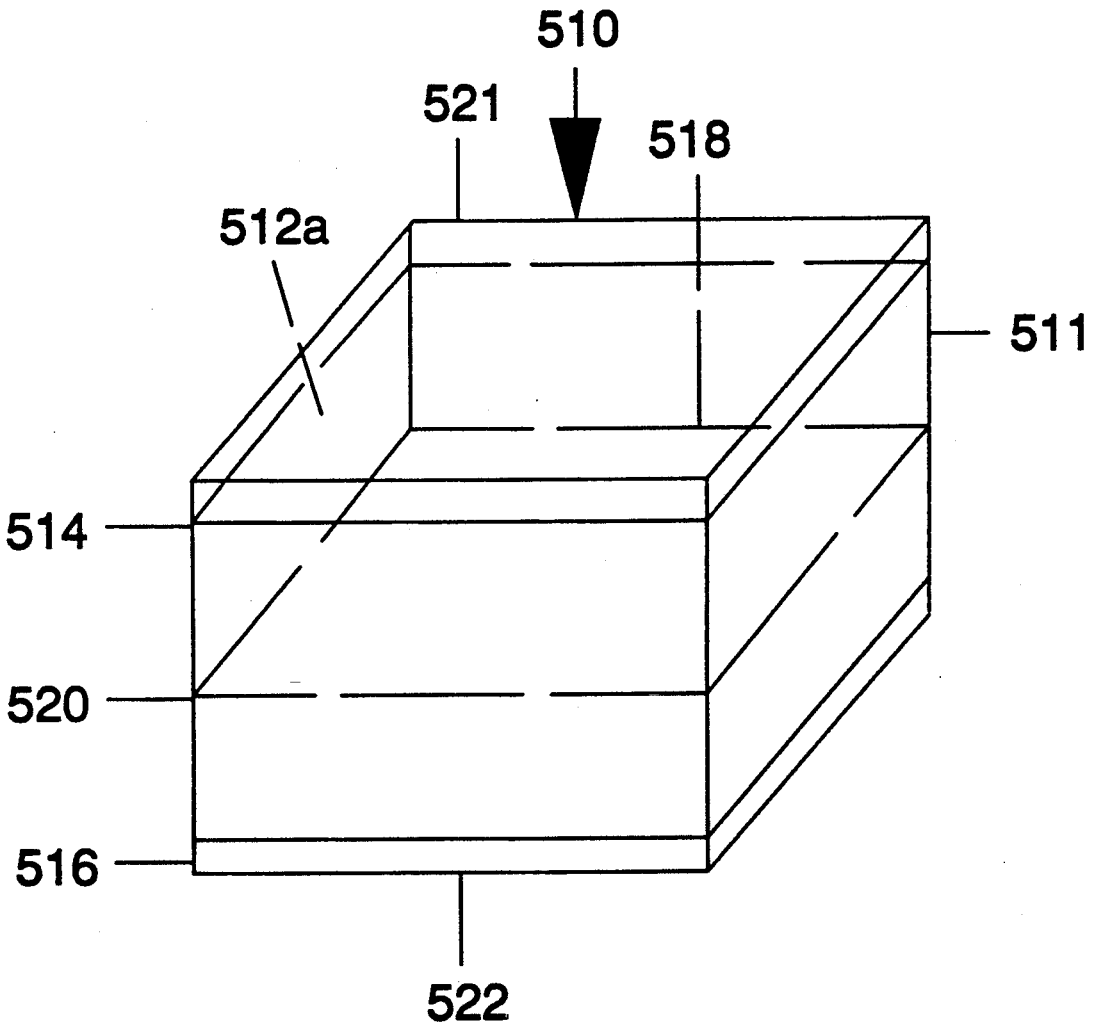
FIG. 16 is a perspective view of another embodiment of the container of the present invention.
Figure 17:
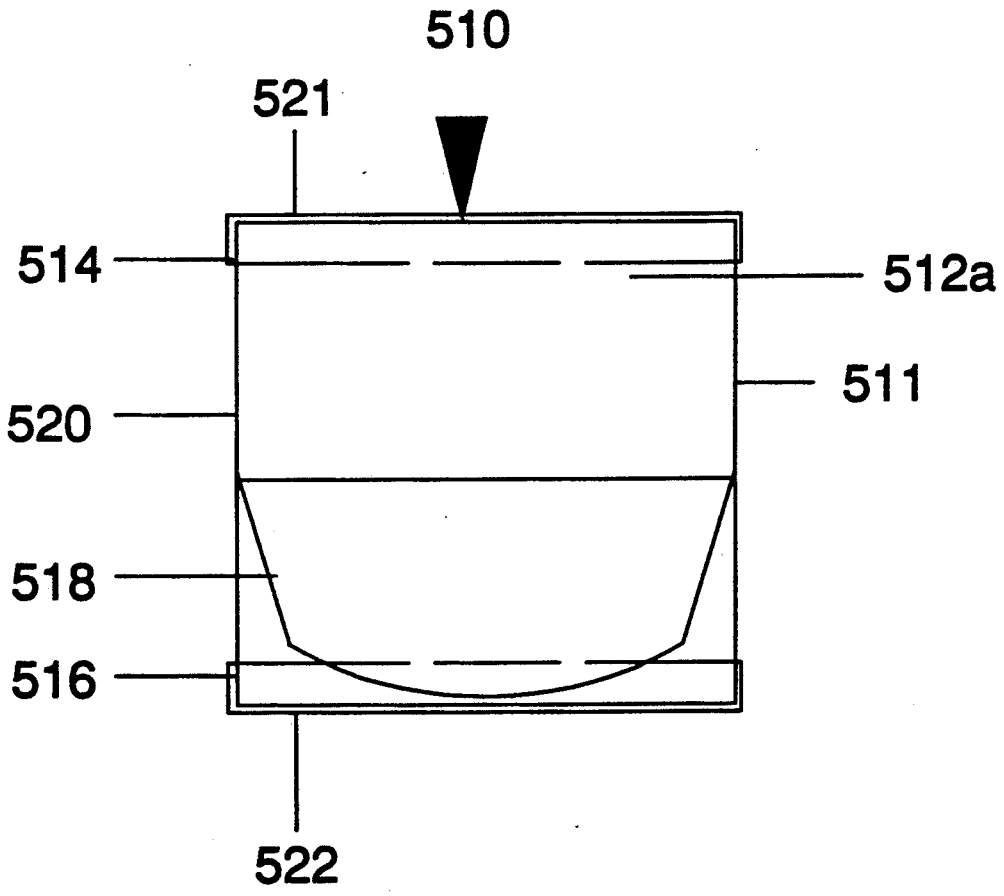
FIG. 17 is a sectional view of the container of FIG. 16 in an upright configuration.
Figure 18:
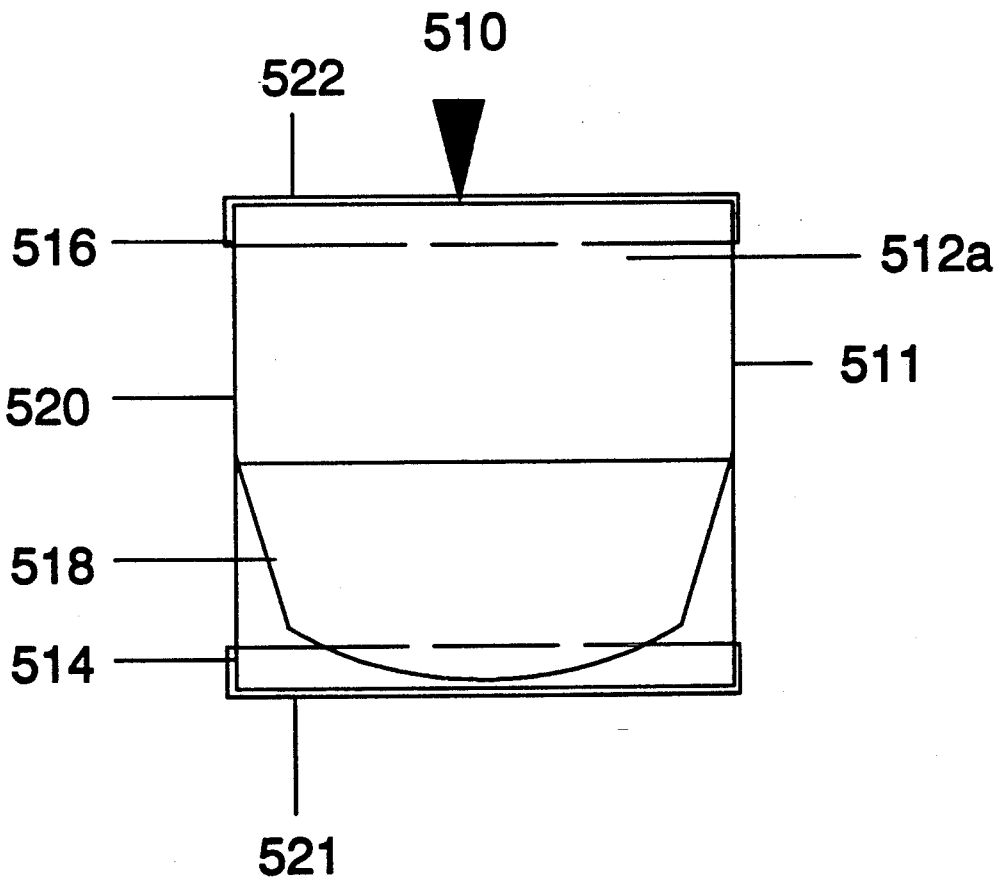
FIG. 18 is a sectional view of the container of FIG. 16 in an inverted configuration.

Another embodiment of the present invention is illustrated in FIGS. 16–18. In this embodiment, the container 510 having a sidewall 511 preferably having a rectangular shape defining a cavity 512*a* and a pair of opposed ends 514 and 516. The container 510 has a flexible liner 518 secured to a central portion 520 of the sidewall 511, such that the liner 518 may be moved between a first position with the liner 518 located adjacent the end 516 of the sidewall in an upright position of the sidewall 511, as shown in FIG. 17, and a second position with the liner 518 located adjacent the other end 514 of the sidewall 511, as shown in FIG. 518. The liner 518 may be any suitable type of flexible material, such as a fluid impervious plastic material, paper, or aluminum foil.

Thus, the container 510 may be utilized to store articles in the cavity 512*a* of the sidewall 511 in either the upright configuration of the container, as shown in FIG. 17, or the inverted configuration of the sidewall, as shown in FIG. 18. In either case, the liner 518 serves to receive and store the articles in the cavity 512*a*, and the sidewall 511 facilitates to pour the articles from the container. If desired, the container may be reversed in configuration once it has been used in the other configuration. Thus, the container is reversible in use.

The container 510 has a pair of caps or lids 521 and 522 closing the opposed ends 514 and 516 of the sidewall 511. The caps 521 and 522 may be releasably secured to the sidewall 511 or the caps 521 and 522 may be secured in sealing engagement to the sidewall 511. Thus, the container 510 is open or closed.

Figure 19:
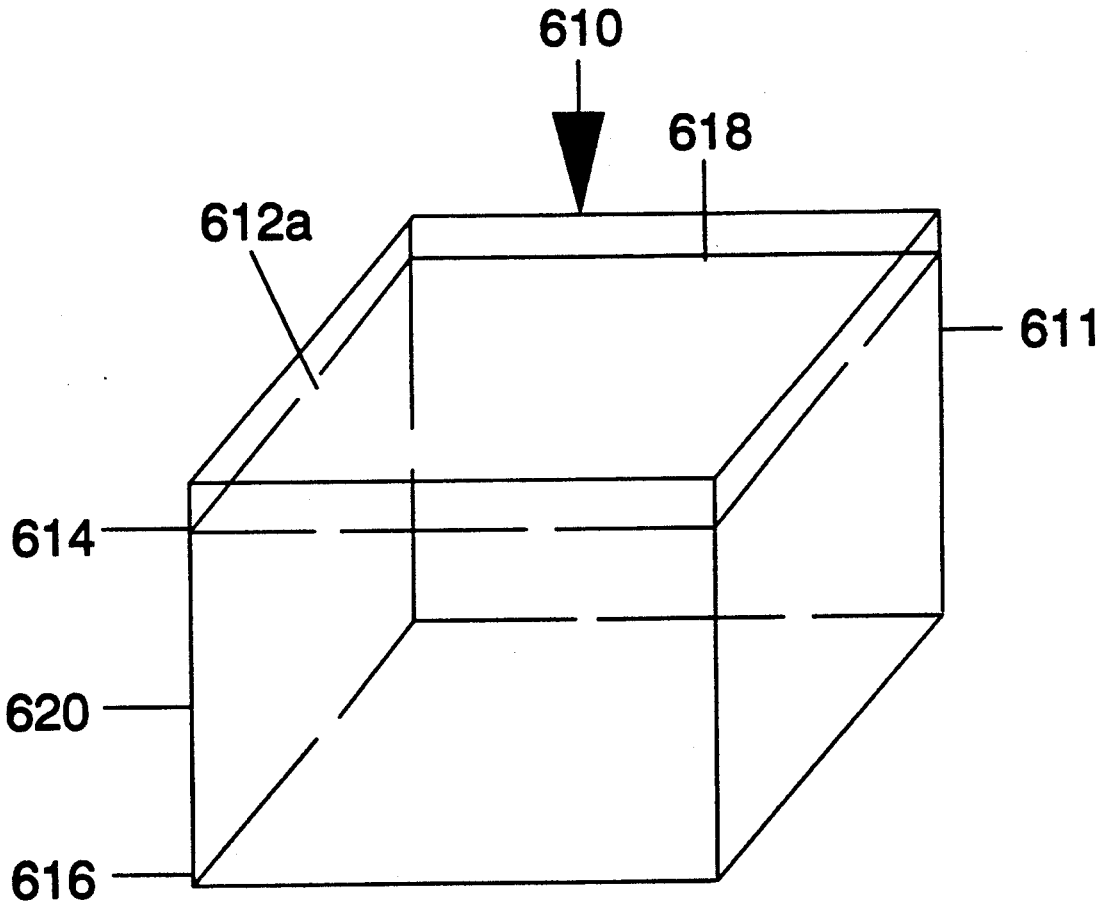
FIG. 19 is a perspective view of another embodiment of the container of the present invention.
Figure 20:
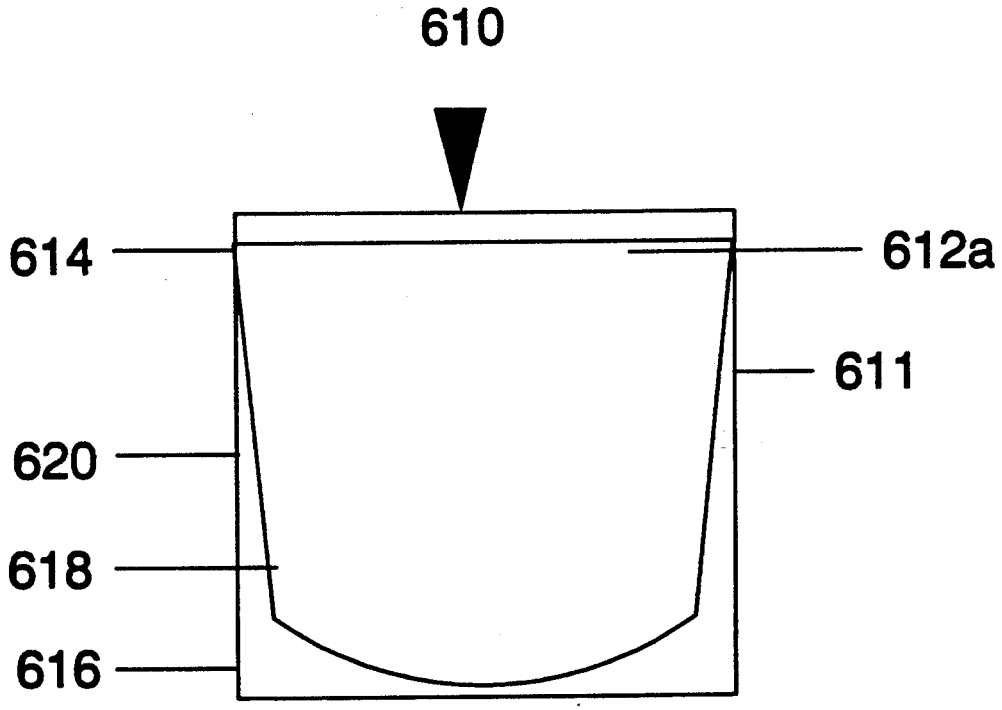
FIG. 20 is a sectional view of the container of FIG. 19 with a liner in a retracted configuration.
Figure 21:
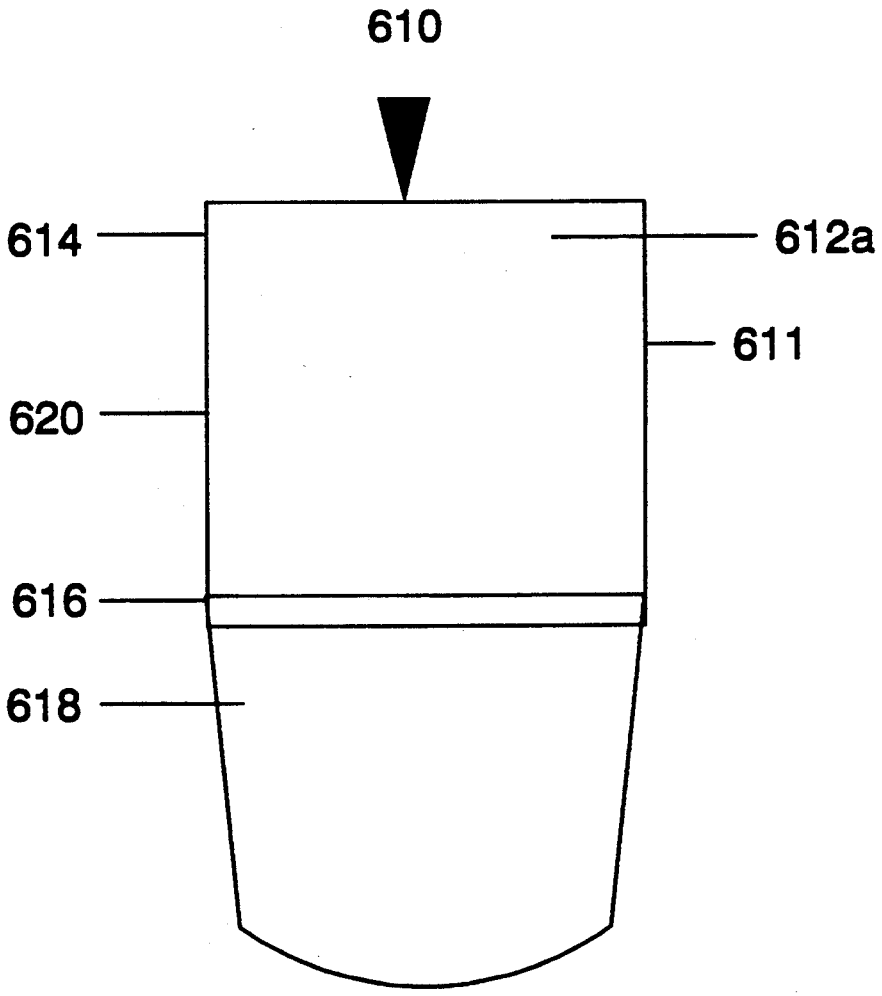
FIG. 21 is a sectional view of the container of FIG. 19 with the container in an inverted configuration and with the liner in an expanded configuration.

Another embodiment of the present invention is illustrated in FIGS. 19–12. In this embodiment, the container 610 has a sidewall 611 preferably having a rectangular shape defining a cavity 512*a*, a pair of opposed ends 614 and 616, and a central portion 620. The container 510 has a flexible liner 618 secured adjacent one end 614 of the sidewall 611, such that the liner 618 may be moved between a first position with the liner 618 located adjacent the end 616 of the sidewall inside the sidewall 611 in an upright position of the sidewall 611, as shown in FIG. 20, and a second position with the liner 618 located outside of the sidewall 611, as shown in FIG. 21, in an inverted configuration of the sidewall 611. The liner 618 may be any suitable type of flexible material, such as a fluid impervious plastic material, paper, or aluminum foil.

Thus, the container 610 may be utilized to store articles in the cavity 612*a* of the sidewall 611 in either the retracted configuration of the container, as shown in FIG. 20, or the expanded configuration of the sidewall, as shown in FIG. 21. In either case, the liner 618 serves to receive and, store the articles in the cavity 612*a*, and the sidewall 611 facilitates to pour the articles from the container. Thus, the effective size of the container may be expanded or diminished to suit the use, as desired.

Figure 22:
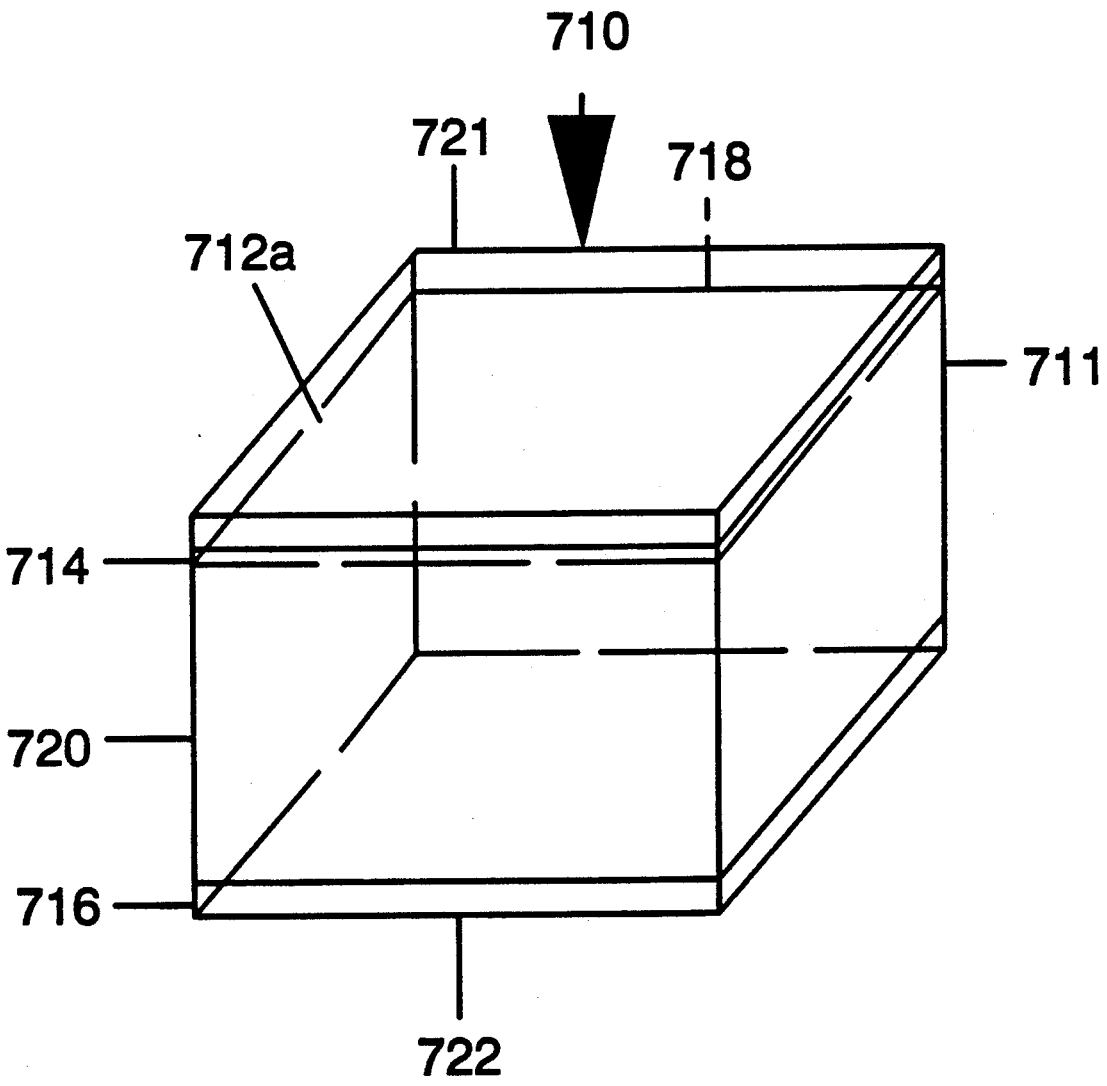
FIG. 22 is a perspective view of another embodiment of the container of the present invention.
Figure 23:
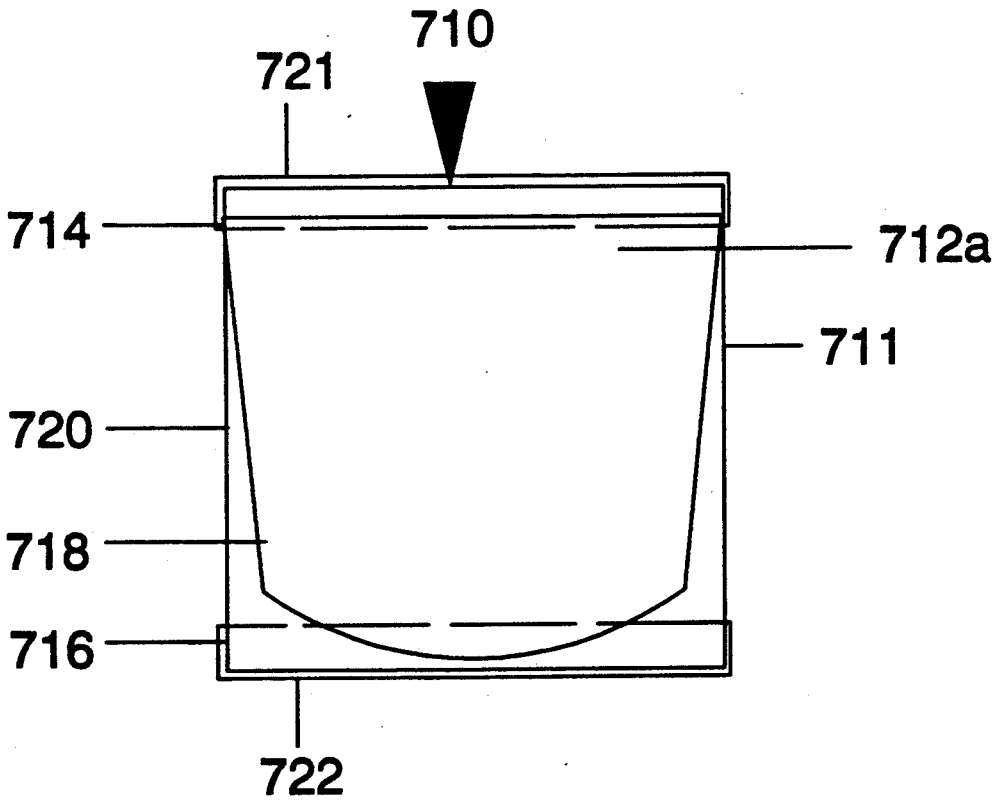
FIG. 23 is a sectional view of the container of FIG. 22 with a liner in a retracted configuration.
Figure 24:
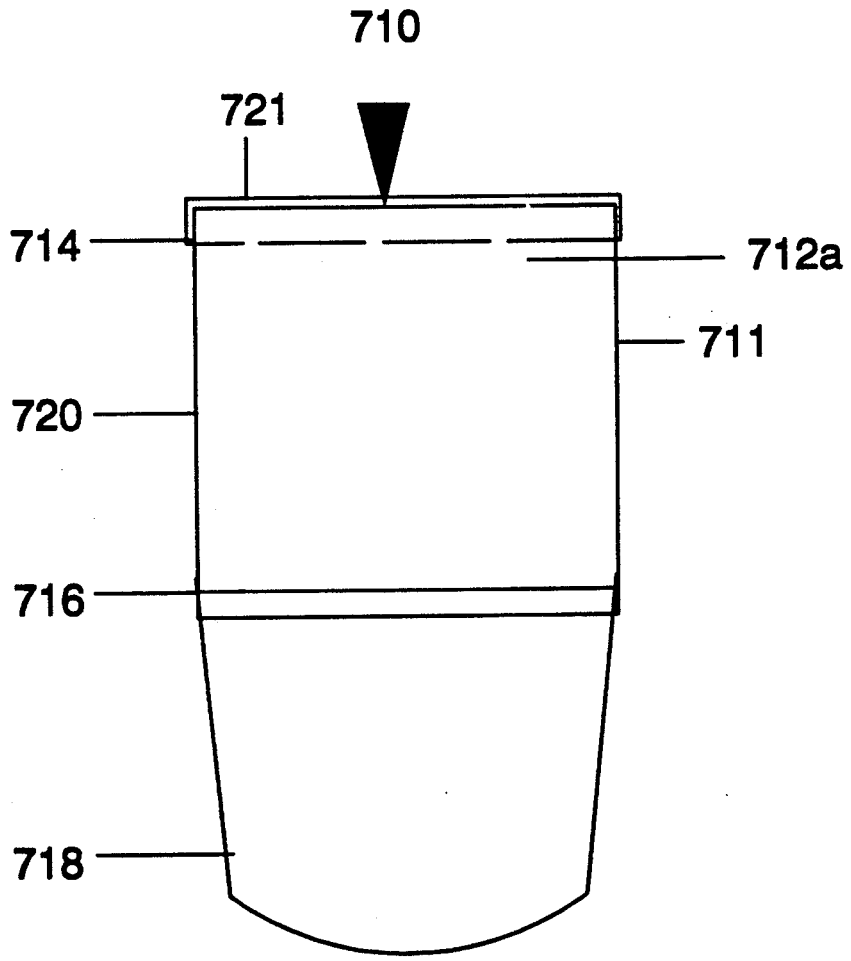
FIG. 24 is a sectional view of the container of FIG. 22 with the container in an inverted configuration and with the liner in an expanded configuration.

Another embodiment of the present invention is illustrated in FIGS. 22–24. In this embodiment, the container 710 has a sidewall 711 having a generally rectangular shape defining a cavity 712*a*, a pair of opposed ends 714 and 716, and a central portion 720. The container 710 has a flexible liner 718 secured adjacent one end 714 of the sidewall 711, such that the liner 718 may be moved between a first position with the liner 718 located adjacent the end 716 of the sidewall inside the sidewall 711 in an upright position of the sidewall 711, as shown in FIG. 23, and a second position with the liner 718 located outside of the sidewall 711, as shown in FIG. 24, in an inverted configuration of the sidewall 711. The liner 718 may be any suitable type of flexible material, such as a fluid impervious plastic material, paper, or aluminum foil.

Thus, the container 710 may be utilized to store articles in the cavity 712*a* of the sidewall 711 in either the retracted configuration of the container, as shown in FIG. 23, or the expanded configuration of the sidewall, as shown in FIG. 24. In either case, the liner 718 serves to receive and store the articles in the cavity 712*a*, and the sidewall 711 facilitates to pour the articles from the container. Thus, the effective size of the container may be expanded or diminished to suit the use, as desired.

The container 10 has a pair of caps or lids 21 and 22 closing the opposed ends 14 and 116 of the sidewall 11. The caps 21 and 22 may be releasably secured to the sidewall 11 or the caps 21 and 22 may be secured in sealing engagement to the sidewall 11. Thus, the container 10 is open or closed.

Figure 25:
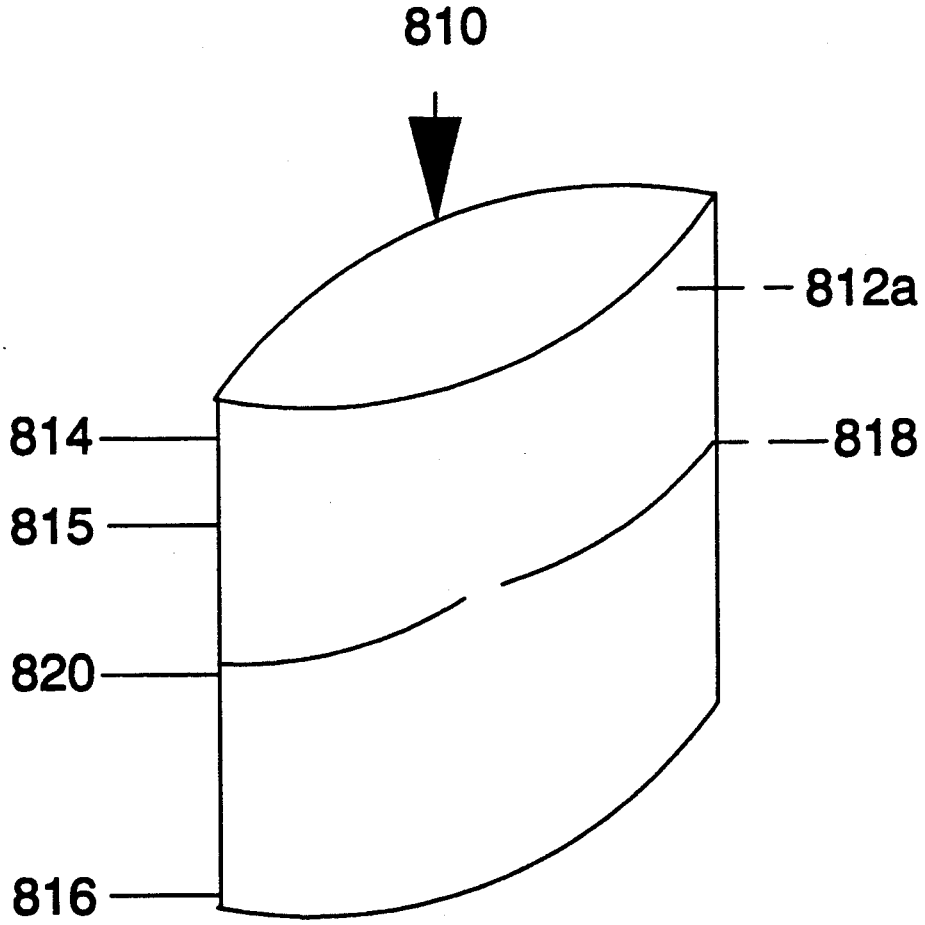
FIG. 25 is a perspective plan view of another embodiment of a package of the present invention.
Figure 26:
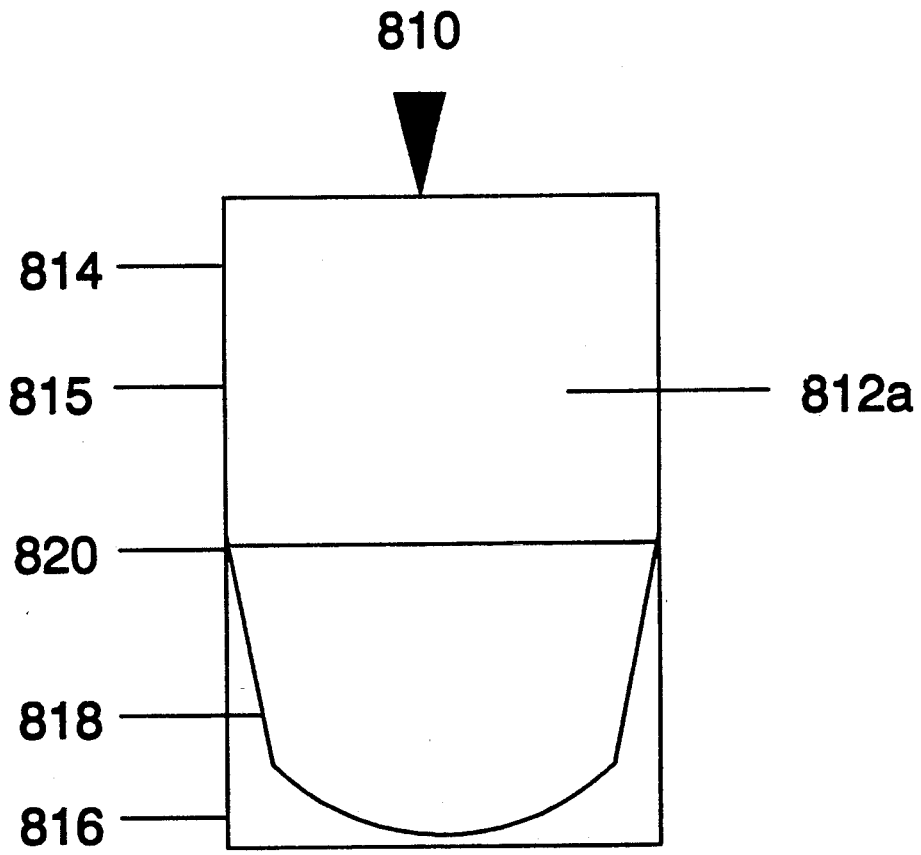
FIG. 26 is a sectional view of the package of FIG. 25 in an upright configuration.
Figure 27:
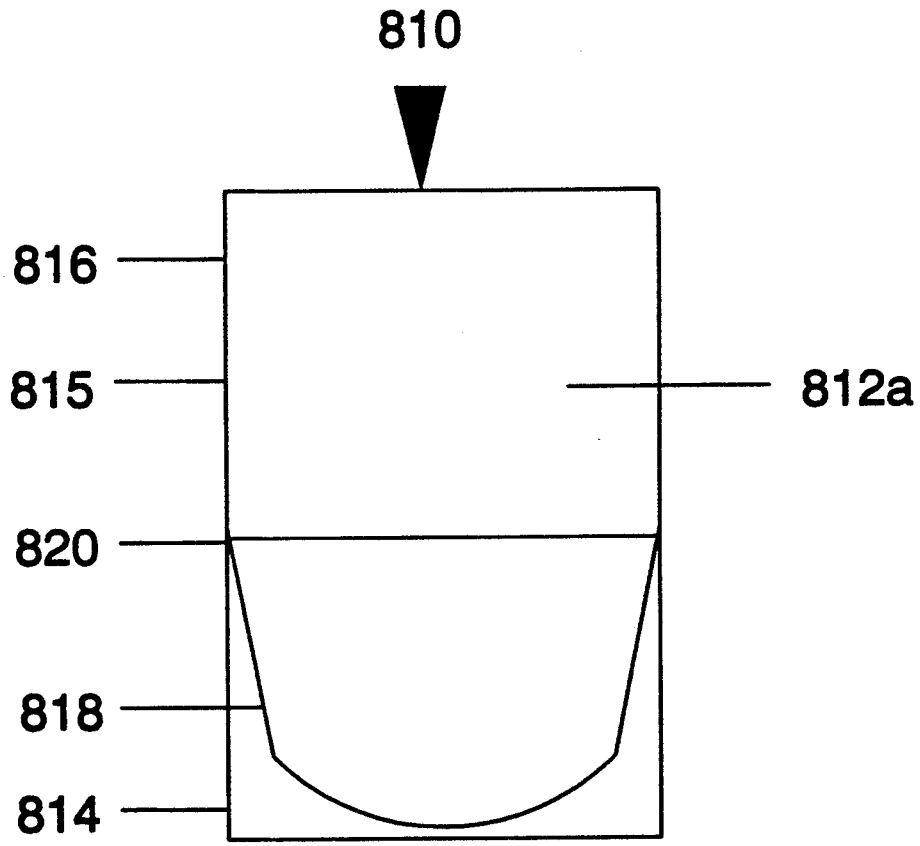
FIG. 27 is a sectional view of the package of FIG. 25 in an inverted configuration.

Another embodiment of the present invention is illustrated in FIGS. 25–27. In this embodiment, a package or container 810 has a flexible wall 815, such as a suitable plastic or paper, defining a cavity 812*a* and a pair of opposed ends 814 and 816. The package 810 has a flexible liner 818 secured to a central portion 820 of the wall 815, such that the liner 818 may be moved between a first position with the liner 818 located adjacent the end 816 of the wall in an upright position of the wall 815, as shown in FIG. 26, and a second position with the liner 818 located adjacent the other end 814 of the wall 815, as shown in FIG. 27. The liner 818 may be any suitable type of flexible material, such as a fluid impervious plastic material, paper, or aluminum foil.

Thus, the package 810 may be utilized to store articles in the cavity 812*a* of the wall 815 in either the upright configuration of the package, as shown in FIG. 26, or the inverted configuration of the package, as shown in FIG. 27. In either case, the liner 818 serves to receive and store the articles in the cavity 812*a*, and the wall 815 facilitates to pour the articles from the package. If desired, the package may be reversed in configuration once it has been used in the other configuration. Thus, the package is reversible in use.

Figure 28:
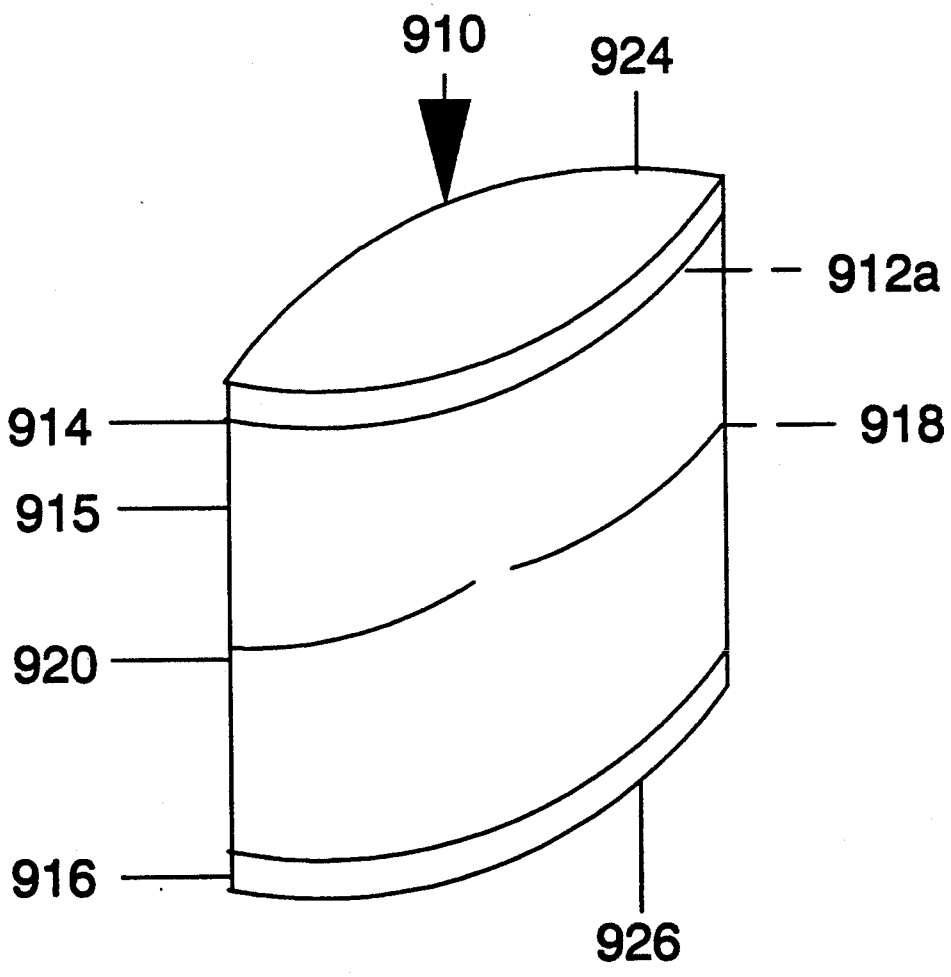
FIG. 28 is a perspective view of another embodiment of the package of the present invention.
Figure 29:
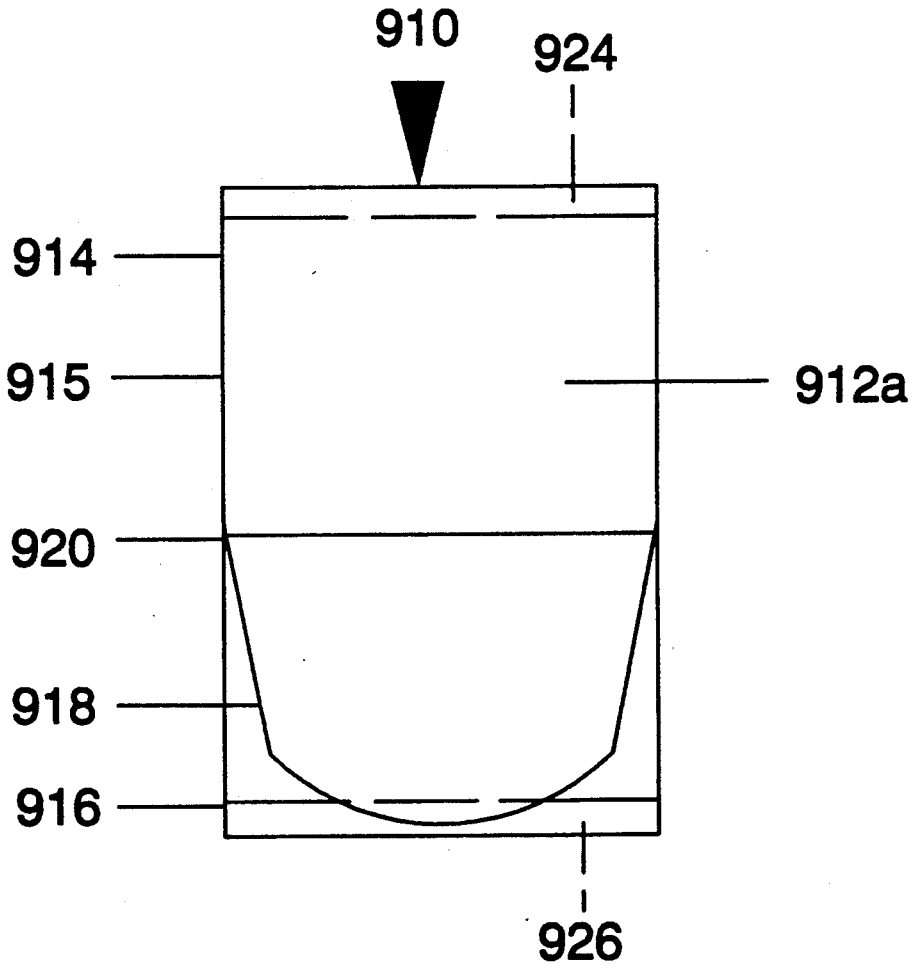
FIG. 29 is a sectional view of the package of FIG. 28 in an upright configuration.
Figure 30:
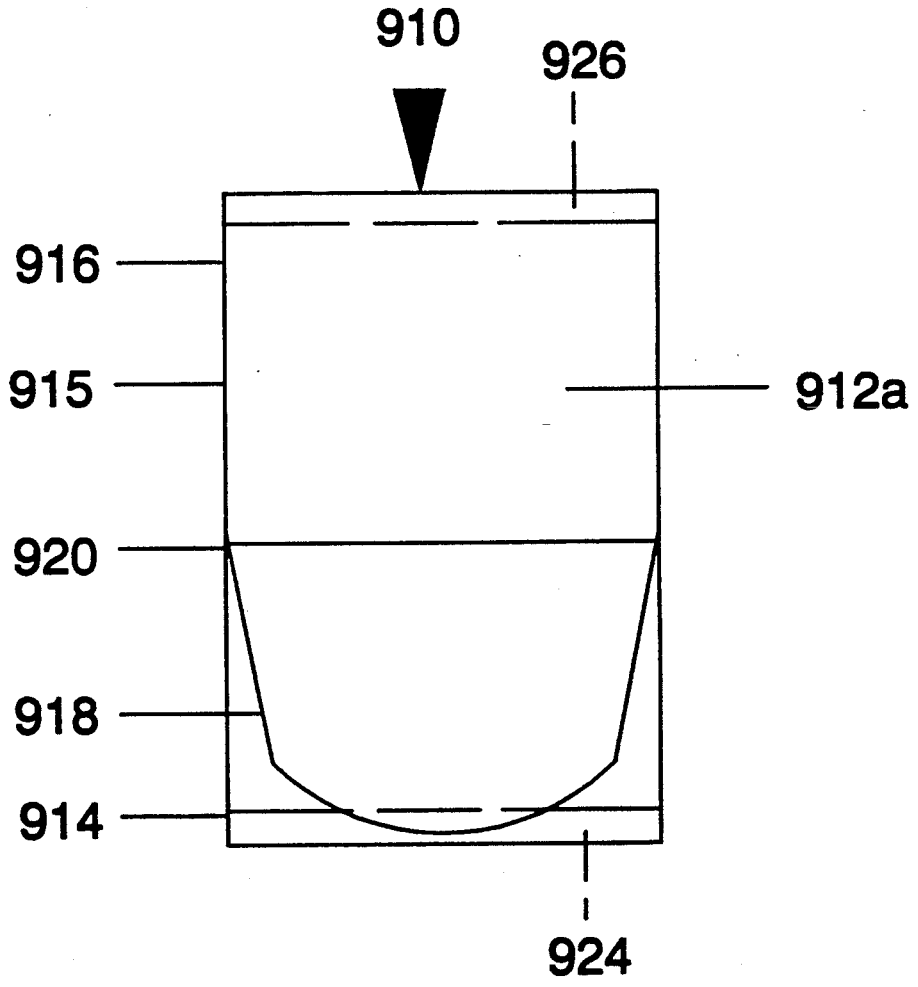
FIG. 30 is a sectional view of the package of FIG. 28 in an inverted configuration.

Another embodiment of the present invention is illustrated in FIGS. 28–30. In this embodiment, the package or container 910 has a flexible wall 915, such as a suitable plastic or paper defining a cavity 912*a* and a pair of opposed ends 914 and 916. The package 910 has a flexible liner 918 secured to a central portion 920 of the wall 915, such that the liner 918 may be moved between a first position with the liner 918 located adjacent the end 916 of the wall in an upright position of the wall 915, as shown in FIG. 29, and a second, position with the liner 918 located adjacent the other end 914 of the wall 915, as shown in FIG. 30. The liner 918 may be any suitable type of flexible material, such as a fluid impervious plastic material, paper, or aluminum foil.

Thus, the package 910 may be utilized to store articles in the cavity 912*a* the wall 915 in either the upright configuration of the package, as shown in FIG. 29, or the inverted configuration of the wall, as shown in FIG. 30. In either case, the liner 918 served to receive and store the articles in the cavity 912*a*, and the wall 915 facilitates to pour the articles from the package. If desired, the package may be reversed in configuration once it has been used in the other configuration. Thus, the package is reversible in use.

The package 910 has a pair of closures or seals 924 and 926, such as heat seals or adhesive, closing the opposed ends 914 and 916 of the wall 915. The walls are releasably sealed to each other by the seals 924 and 926. Thus, the container 910 is open or closed.

Figure 31:
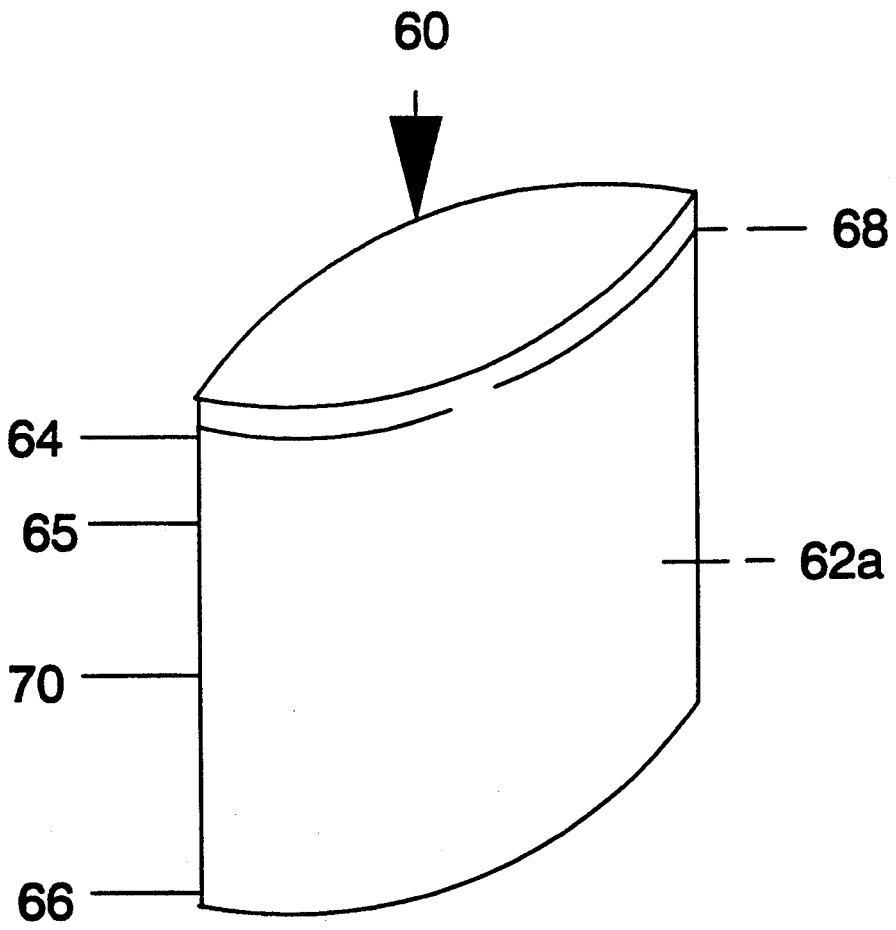
FIG. 31 is a perspective view another embodiment of the package of the present invention.
Figure 32:
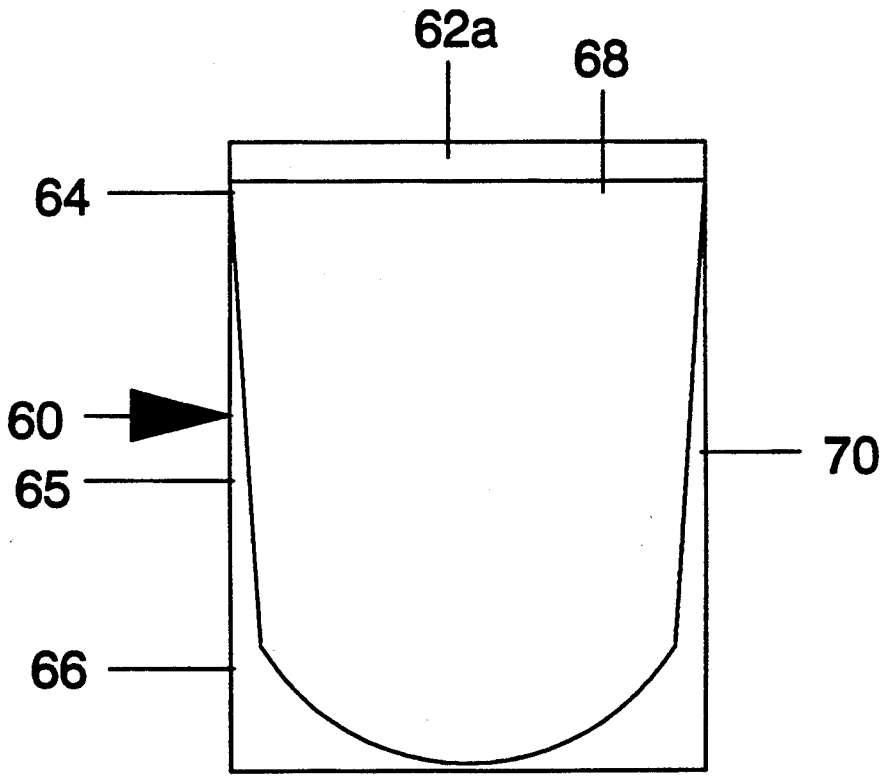
FIG. 32 is a sectional view of the package of FIG. 31 with a liner in a retracted configuration.
Figure 33:
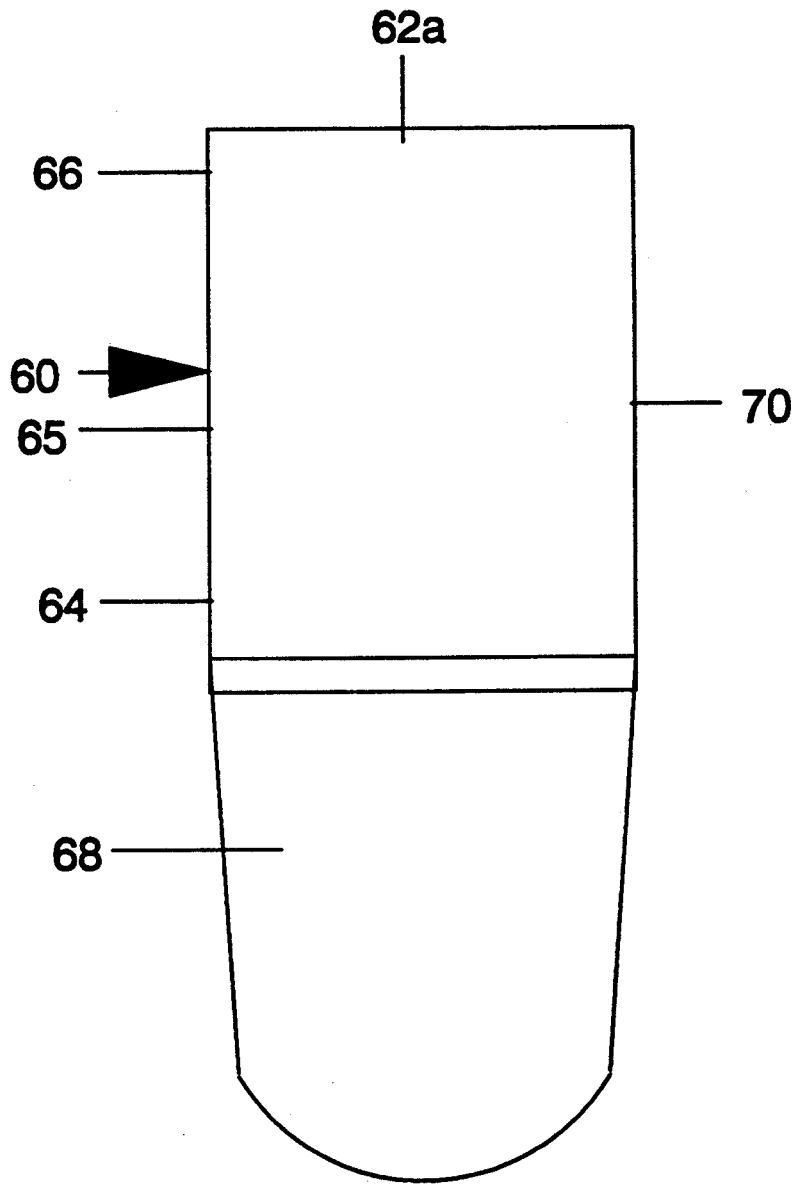
FIG. 33 is a sectional view of the package of FIG. 31 with the package in an inverted configuration and with the liner in an expanded configuration.

Another embodiment of the present invention is illustrated in FIGS. 31–33. In this embodiment, the package or container 60 has a flexible wall 65, such as a suitable plastic or paper, defining a cavity 62*a*, a pair of opposed ends 64 and 66, and a central portion 70. The package 60 has a flexible liner 68 secured adjacent one end 64 of the wall 65, such that the liner 68 may be moved between a first position with the liner 68 located adjacent the end 66 of the wall inside the wall 65 in an upright position of the wall 65, as shown in FIG. 32, and a second position with the liner 68 located outside of the wall 65, as shown in FIG. 33, in an inverted configuration of the wall 65. The liner 68 may be any suitable type of flexible material, such as a fluid impervious plastic material, paper, or aluminum foil.

Thus, the package 60 may be utilized to store articles in the cavity 62*a* of the wall 65 in either the retracted configuration of the package, as shown in FIG. 32, or the expanded configuration of the wall, as shown in FIG. 33. In either case, the liner 68 serves to receive and store the articles in the cavity 62*a*, and the wall facilitates to pour the articles from the package. Thus, the effective size of the package may be expanded or diminished to suit the use, as desired.

Figure 34:
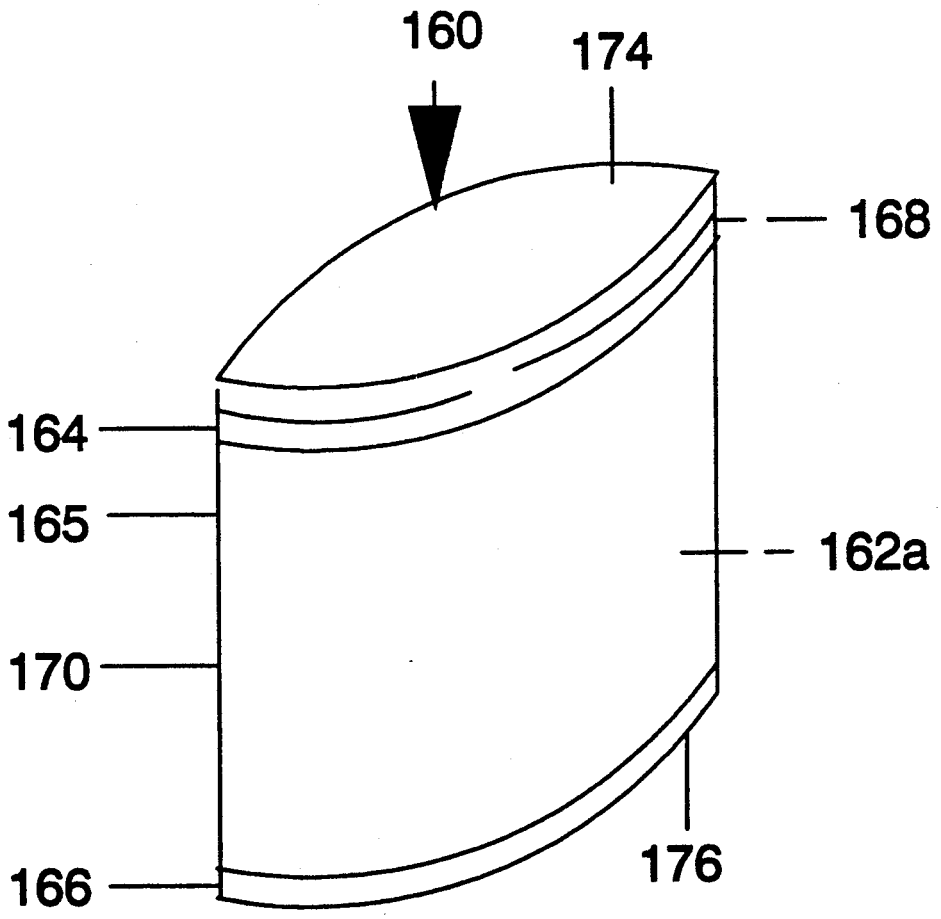
FIG. 34 is a perspective view of another embodiment of the package of the present invention.
Figure 35:
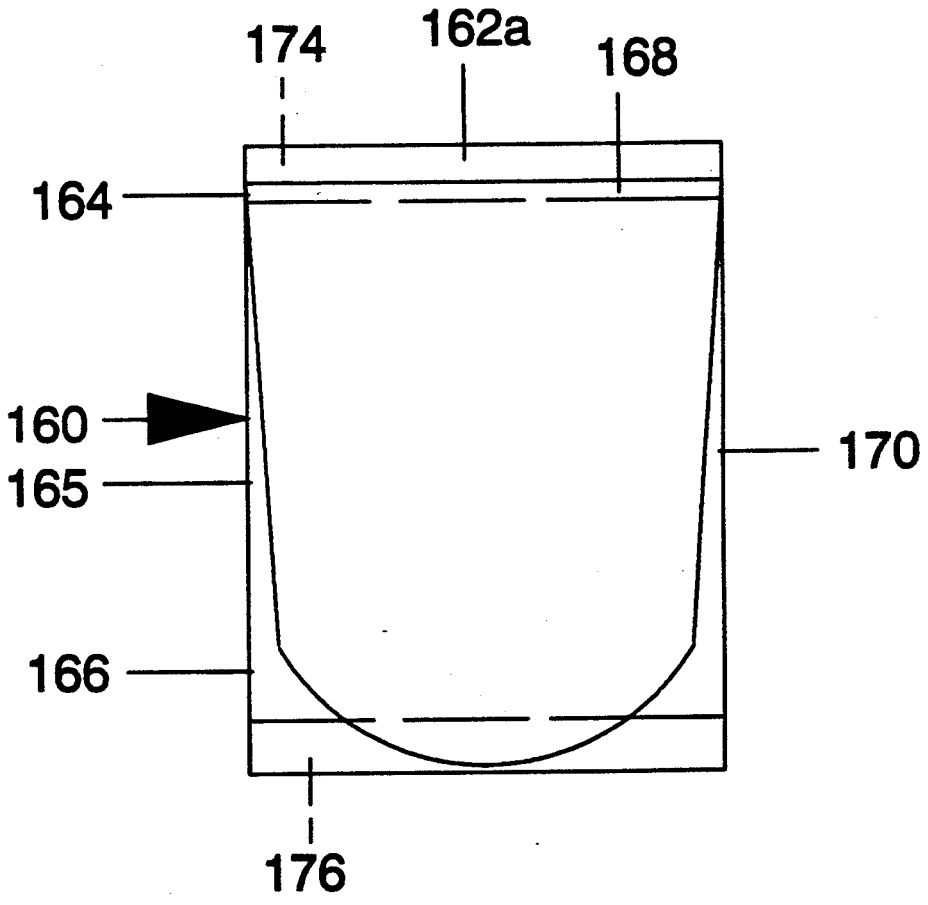
FIG. 35 is a sectional view of the package of FIG. 34 with a liner in a retracted configuration.
Figure 36:
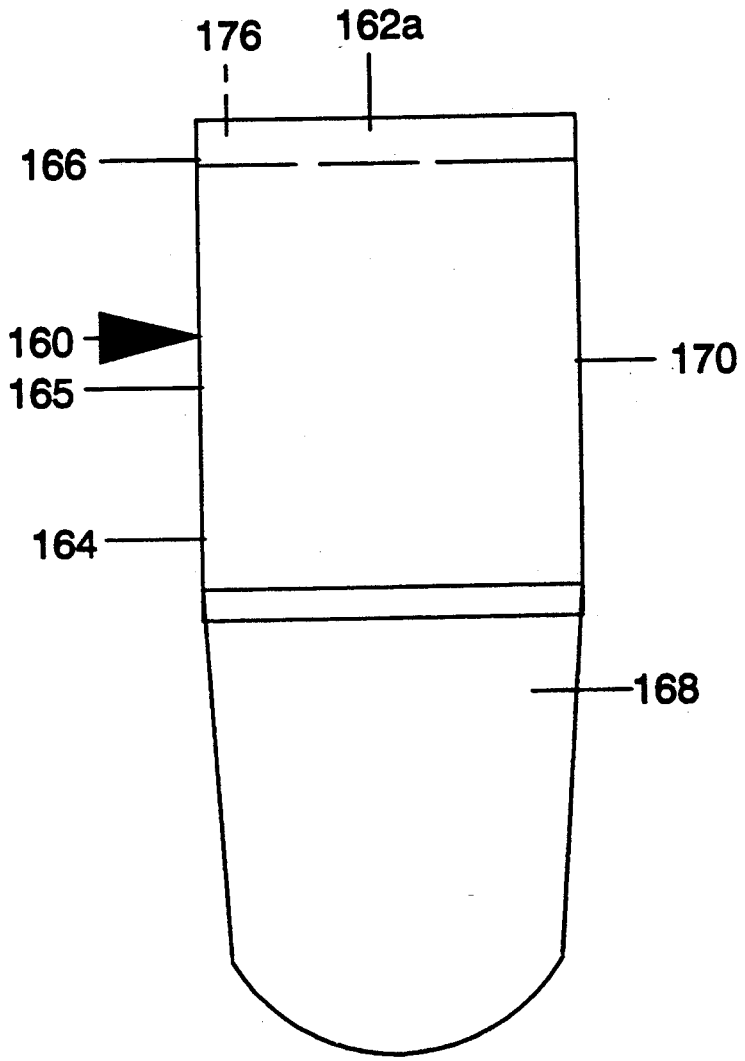
FIG. 36 is a sectional view of the package of FIG. 34 with the package in an inverted configuration and with the liner in an expanded configuration.

Another embodiment of the present invention is illustrated in FIGS. 34–36. In this embodiment, the package or container 160 has a flexible wall 165, such as plastic or paper defining a cavity 162*a*, a pair of opposed ends 164 and 166, and a central portion 170. The package 160 has a flexible liner 168 secured adjacent one end 164 of the wall 165, such that the liner 168 may be moved between a first position with the liner 168 located adjacent the end 166 of the wall inside the wall 165 in an upright position of the wall 165, as shown in FIG. 35, and a second position with the liner 168 located outside of the wall 165, as shown in FIG. 36, in an inverted configuration of the wall 165. The liner 168 may be any suitable type of flexible material, such as a fluid impervious plastic material, paper, or aluminum foil.

Thus package 160 may be utilized to store articles in the cavity 162*a* of the wall 165 in either the retracted configuration of the package, as shown in FIG. 35, or the expanded configuration of the wall, as shown in FIG. 36. In either case, the liner 168 serves to receive and store the articles in the cavity 162*a*, and the wall 165 facilitates to pour the articles from the package. Thus, the effective size of the package may be expanded or diminished to suit the use, as desired.

The package 160 has a pair of seals 174 and 176, such as heat seals or adhesive, closing the opposed ends 164 and 166 of the wall 165. The walls 15 are releasably secured by the seals 174 and 176. Thus, the package 150 is open or closed.

The foregoing detailed description has been given for clearness of understanding only, and no unnecessary limitations should be understood therefrom, as modifications will be obvious to those skilled in the art.

What is claimed is:

1. A container comprising, a tube, and a flexible liner being secured to a central portion of the tube such that the liner may flex about the central portion of the tube and move between positions adjacent opposed ends of the tube, with the length of the liner from the central portion of the tube to the opposed ends of the tube being approximately the same.

2. The container of claim 1 including a cap closing at least one of said ends.

3. The container of claim 2 in which the container has a pair of caps closing both the opposed end of the tube.

4. The container of claim 2 in which the cap is secured in sealing engagement to the tube.

5. A container comprising, a sidewall defining a cavity, and a flexible liner being secured to a central portion of the sidewall such that the liner may flex about the central portion of the sidewall and move between positions adjacent opposed ends of the sidewall, with the liner having approximately an equal length as measured between the central portion of the sidewall to said opposed ends of the sidewall.

6. The container of claim 5 wherein the sidewall is generally rectangular.

7. The container of claim 5 including a cap closing at least one of said ends.

8. The container of claim 5 in which the container has a pair of caps closing both the opposed ends.

9. The container of claim 5 in which a cap is secured in sealing engagement to the sidewall.

10. A package comprising, a flexible wall defining a cavity, and a flexible liner being secured to a central portion of the wall such that the liner may move between positions adjacent opposed ends of the wall.

11. The package of claim 10 including a seal closing at least one of said ends.

12. The package of claim 11 in which the package has a pair of seals closing both the opposed ends.

13. The package of claim 11 in which the seal releasably closes the wall.

14. A container comprising, a tube, and a flexible liner being secured to a central portion of the tube such that the liner may move between positions adjacent opposed ends of the tube, including a cap closing at least one of said ends, and in which the cap is releasably attached to the tube.

15. A container comprising, a sidewall defining a cavity, and a flexible liner being secured to a central portion of the sidewall such that liner may move between positions adjacent opposed ends of the sidewall, in which a cap is releasably attached to the sidewall.

* * * * *